US005672934A

United States Patent [19]

Ohama et al.

[11] Patent Number: 5,672,934

[45] Date of Patent: Sep. 30, 1997

[54] COLOR CATHODE-RAY TUBE HAVING A SHADOW MASK WITH IMPROVED ARRAYS OF APERTURES

[75] Inventors: Shinji Ohama, Kitamoto; Norio Shimizu; Takashi Murai, both of Fukaya; Ichiro Saotome, Urawa; Masatsugu Inoue, Kumagaya; Kumio Fukuda, Fukaya, all of Japan

[73] Assignee: Kabushiki Kaisha Toshiba, Kawasaki, Japan

[21] Appl. No.: 502,174

[22] Filed: Jul. 13, 1995

[30] Foreign Application Priority Data

Jul. 14, 1994 [JP] Japan ..... 6-161942
Oct. 6, 1994 [JP] Japan ..... 6-242560

[51] Int. Cl.[6] ..... H01J 29/80

[52] U.S. Cl. ..... 313/402; 313/403; 313/408

[58] Field of Search ..... 313/402, 403, 313/407, 408, 461

[56] References Cited

U.S. PATENT DOCUMENTS

| | | | |
|---|---|---|---|
| 3,889,145 | 6/1975 | Suzuki et al. | 313/403 X |
| 3,947,718 | 3/1976 | Van Lent | 313/403 X |
| 4,583,022 | 4/1986 | Masterton | 313/403 |
| 4,631,441 | 12/1986 | Morrell et al. | 313/408 |
| 4,636,683 | 1/1987 | Tokita et al. | 313/403 |
| 4,665,339 | 5/1987 | Masterton et al. | 313/408 |
| 4,691,138 | 9/1987 | Masterton | 313/403 |
| 4,727,282 | 2/1988 | Tokita et al. | 313/403 |

FOREIGN PATENT DOCUMENTS

| | | |
|---|---|---|
| 5-1574 | 1/1993 | Japan . |
| 5-42772 | 1/1993 | Japan . |

*Primary Examiner*—Sandra L. O'Shea
*Assistant Examiner*—Jay M. Patidar
*Attorney, Agent, or Firm*—Cushman Darby & Cushman Intellectual Property Group of Pillsbury Madison & Sutro LLP

[57] ABSTRACT

A color-cathode ray tube having a shadow mask with improved aperture arrays. The aperture arrays are spaced at appropriate intervals and are curved to suppress local doming of the effective part of the shadow mask and to prevent electron-beam mislanding from occurring on a phosphor screen. The distance between any two adjacent apertures is expressed as: $PH(N)=A+BN^2+CN^4$, where PH(N) is the distance between the (N−1)th and Nth arrays and A, B, and C are fourth-degree functions of a Y-coordinate. The apertures along a long side of the effective part of the shadow mask in a section extending for one-fourth of a width of the effective part of the shadow mask from a short side of the effective part of the shadow mask are inclined in an opposite direction to the apertures within the section and located one-third of a height of the effective part of the shadow mask from the long side.

8 Claims, 14 Drawing Sheets

(PRIOR ART)

COLOR CATHODE-RAY TUBE HAVING A SHADOW MASK WITH IMPROVED ARRAYS OF APERTURES

BACKGROUND OF THE INVENTION

1. Field of the Invention

The present invention relates to a color cathode-ray tube of a shadow mask type, and more particularly to a color cathode-ray tube comprising a phosphor screen and a shadow mask which has an effective part having arrays of apertures extending parallel to the short axis of the effective part and juxtaposed along the long axis thereof. The aperture arrays are spaced apart, and the apertures of each array are inclined such that electron beams passing through the apertures of the shadow mask land at desired positions on the phosphor screen, enhancing the quality of the phosphor screen.

2. Description of the Related Art

Generally, a color cathode-ray tube comprises a panel 2, a funnel 3, a shadow mask 6, an electron gun 9, and a beam-deflecting unit 10, as illustrated in FIG. 1. The panel 2 and the funnel 3 are connected together, forming an envelope. The panel 2 has an effective part 1. Provided on the inner surface of the effective part 1 is a phosphor screen 4. The screen 4 consists of blue-emitting phosphor layers, green-emitting phosphor layers and red-emitting phosphor layers. The shadow mask 6 is provided in the envelope and faces the phosphor screen 4. The mask 6 has an effective part 5 which is substantially rectangular. The effective part 5 is curved and has arrays of apertures. The electron gun 9 is provided in the neck 7 of the funnel 3, for emitting three electron beams 8B, 8G and 8R. The beam-deflecting unit 10 is located outside the envelope, more precisely mounted on the funnel 3. In operation, the beams 8B, 8G and 8R emitted from the gun 9 are deflected in horizontal and vertical planes, pass through the apertures of the shadow mask 6, and are applied onto the phosphor screen 4, whereby the cathode-ray tube displays a color image.

Various color cathode-ray tubes which have the structure described above are known. One of them is an in-line color cathode-ray tube, in which three electron beams 8B, 8G and 8R travel in the same horizontal plane. The blue-emitting phosphor layers, green-emitting phosphor layers and red-emitting phosphor layers which constitute the phosphor screen 4 of the in-line cathode-ray tube are elongated stripes which extend vertically. The shadow mask 6 of the cathode-ray tube has arrays of apertures in its effective part. The aperture arrays extend along the short axis Y of the effective part 5 and are juxtaposed along the long axis X of the effective part 5.

The shadow mask 6 is a color-selecting electrode. The electron beams 8B, 8G and 8R are guided through each aperture of the mask 6, traveling at different angles with respect to the mask 6. The beams 8B, 8G and 8R must land correctly on the adjacent blue-emitting phosphor stripe, green-emitting phosphor stripe and red-emitting phosphor stripe of the screen 4, respectively. Otherwise, the in-line color cathode-ray tube cannot display an image having high color purity. To achieve correct landing of the beams, the apertures of the shadow mask 6 need to be aligned with the phosphor stripes during the entire time that the cathode-ray tube is operating. More precisely, throughout the operation of the cathode-ray tube, the mask 6 must be held at such a position that the distance q between its effective part 5 and the effective part 1 of the panel 2 remains within a limited range.

Due to the operating principle of a shadow-mask type color cathode-ray tube, only one third or less of each electron beam emitted from the gun passes through an aperture of the shadow mask 6 and reaches the phosphor screen 4. The other part of the electron beam impinges on the mask 6 and is converted into thermal energy, heating the shadow mask 6. Thus heated, the shadow mask 6 warps toward the phosphor screen 4 as indicated by the one-dot, one-dash line shown in FIG. 2, because it is made of low-carbon steel which has a large coefficient of thermal expansion. Due to this warping, known as "doming," the apertures change their positions. Consequently, the distance q between its effective part 5 and the effective part 1 of the panel 2 decreases. If the distance q excessively decreases to a value outside the limited range, each electron beam will fail to land on the target phosphor stripe 11, and the cathode-ray tube will display an image having insufficient color purity.

The erroneous electron-beam landing caused by the doming of the shadow mask 6 is known as "mislanding." The degree of mislanding greatly depends on the luminance of the image to display, the period of displaying that image, and the like. When the image displayed has a high-luminance part, a so-called local doming develops within a short period of time as illustrated in FIG. 2. The local doming causes the mislanding of many electron-beams.

To analyze the mislanding caused by local doming, experiments were conducted. In the experiments, a window-like pattern 14 was displayed on the phosphor screen of a color cathode-ray tube as shown in FIG. 3, by using a pattern signal generator. Formed by applying large-current electron beams to the screen, the pattern 14 had high luminance. It extended along the short axis Y of the phosphor screen.

The window-like pattern 14 changed in shape and position, due to the electron-beam mislanding. The mislanding was the greatest when the pattern 14 was displayed at a distance of about W/3 from the short axis Y of the screen, where W is the width of the screen. To be more precise, the mislanding was most prominent in the elliptical region 15 of the screen, which is shown in FIG. 4.

Why the electron-beam mislanding was most prominent in the region 15 will be discussed with reference to FIG. 5. If the pattern 14 is displayed in the central region of the screen shown in FIG. 3, the central part of the shadow mask will undergo thermal expansion. In this case, the mislanding of beams will be trivial since the beams passing through the apertures made in that central part are deflected by small angles. The farther the pattern 14 is located from the short axis Y of the screen, the greater the incident angles of the electron beams applied to form the pattern. The greater the incident angles, the more prominent the electron-beam mislanding of the beams. Nonetheless, if the pattern 14 is displayed in the left or right edge region of the screen, the mislanding will be small. This is because the deforming of the shadow mask is suppressed by the rigid frame which holds the shadow mask. Hence, the mislanding resulting from the thermal expansion of the shadow mask is the greatest when the pattern 14 is at a distance of about one-third the width W of the screen, from the short axis Y of the screen.

The upper and lower edge parts of the shadow mask will be deformed very little if the shadow mask expands when heated, because the upper and lower edge parts of the shadow mask are fastened to the frame which is rigid and strong. Furthermore, the frame has a heat capacity large enough to absorb the thermal energy which the left, right, upper and lower edge parts of the shadow mask generate when impinged with electron beams. This helps to reduce the deforming of the edge parts of the shadow mask.

Thus, the electron-beam mislanding was most prominent in the elliptical region 15 (FIG. 4) of the phosphor screen. This region 15 faces an elliptical region of the shadow mask, whose center is on the long axis X of the mask and spaced from the short axis Y of the mask by about one-third the width of the mask and whose upper and lower edges are at a distance of about one-fourth the height of the mask, from the long axis X of the mask.

Various methods have been devised to minimize the doming of a shadow mask. One of them is to impart a large curvature to the effective part of the shadow mask, that is, to increase the radius of curvature of the effective part. As experiments show, the doming can be reduced more effectively by decreasing the curvature along the short axis of the mask than by decreasing the curvature along the long axis.

The curvature of the effective part of the shadow mask is determined by the curvature of the inner surface of the effective part of the panel and the deflection characteristic of the beam-deflecting unit, such that the effective parts of the mask and panel are spaced apart by an appropriate distance q. Therefore, when the curvature of the effective part of the mask is altered, the curvature of the inner surface of the effective panel part must be changed in the same fashion. To increase the curvature of the effective part of the mask, thereby to minimize the doming of the mask, it is necessary to increase the curvature of the inner surface of the effective part of the panel to the same value. The curvature of the inner surface of the effective part of the panel may not be increased in the case of a large-screen color cathode-ray tube and a recently developed color cathode-ray tube with a wide screen having an aspect ratio of 16:9. With these cathode-ray tubes there is the trend that the outer surface of the effective part of the panel has a small curvature and is almost flat. If the curvature of the inner surface of the effective part of the panel is increased, the central part of the panel will be far thinner than the edge parts, impairing the operating characteristic of the cathode-ray tube.

If the curvature of the effective part of the mask is increased, while the curvature of the inner surface of the effective part of the panel remains relatively small, the distance q between the effective parts of the mask and panel will be different from the desired value. As is known in the art, the difference between the actual and desired values of the distance q can be compensated for by adjusting the intervals between the aperture arrays made in the effective part of the shadow mask. A shadow mask is known in which the intervals between the aperture arrays gradually increase from the short axis toward the left and right edge of the mask, and whose effective part is curved along the long axis at a large curvature. The effective part of this shadow mask, however, cannot be curved enough along the short axis to prevent the doming of the mask. To increase the curvature along the short axis, the aperture arrays must be arranged such that the distance between any two adjacent aperture arrays gradually increases from the long axis of the mask toward the upper and lower edges of the mask. If all aperture arrays are so arranged, the effective part of the shadow mask cannot remain rectangular. Consequently, the cathode-ray tube cannot have a rectangular screen.

Shadow masks free of this problem are disclosed in Jpn. Pat. Appln. KOKOKU Publication No. 5-1574 (corresponding to U.S. Pat. No. 4,691,138) and Jpn. Pat. Appln. KOKOKU Publication No. 5-42772 (corresponding to U.S. Pat. No. 4,631,441). The shadow mask disclosed in either publication is characterized in that the aperture arrays are less spaced apart near the short axis than in each corner section. The corner sections can therefore be curved along the short axis at a small radius of curvature, while enabling a cathode-ray tube to have a rectangular screen.

The distance PH between any two adjacent aperture arrays is given as:

$$PH=a+bX^2+cX^4$$

where a, b and c are quadratic functions of Y and X and Y are coordinates in a coordinate system whose origin is the center of the effective part and whose axes are the horizontal and vertical axes of the effective part.

As the distance Y from the long axis X of the effective part changes, the distance PH changes as a quadratic function of Y. The curvature at which the effective part of the mask is curved along the short axis Y can only be large uniformly. The local doming of the shadow mask can be suppressed, but not sufficiently to minimize the electron-beam mislanding in the elliptical region 15 (FIG. 4) of the phosphor screen. To minimize the local doming, that part of the shadow mask through which the electron beams are applied onto the elliptical region 15 of the screen must be curved along the short axis Y at a great curvature. This part of the mask cannot be curved so unless PHM2>PHM1. As shown in FIG. 5, PHM1 is the distance between the two adjacent aperture arrays, measured at a point M1 which is located in the long axis X of the shadow mask 6 and which corresponds to the center P1 of the elliptical region 15 (FIG. 4) of the screen. Also shown in FIG. 5, PHM2 is the distance between the two adjacent aperture arrays, measured at a point M2 which is located at a distance of one-fourth the height H' of the effective part of the mask 6 from the long axis X of the mask 6 and which corresponds to the upper end P2 of the elliptical region 15 (FIG. 4) of the screen. If the distance PHM2 is larger than the distance PHM1, however, the distance PHM3 between the adjacent aperture arrays, measured at a point M3 located on a long side of the rectangular shadow mask 6, will be longer than the distance PHM2 as is indicated by broken lines in FIG. 5. This is inevitable because the distance PH between any two adjacent aperture arrays changes as a quadratic function of the distance Y from the long axis X of the effective part. For the shadow mask 6 to have a rectangular effective part, it is required that the distance between other adjacent aperture arrays be extremely short at another points on the long side of the rectangular shadow mask. If the shadow mask 6 is curved in accordance with the distance on the point M3, the distance q between the effective part of the mask and the panel will be excessive long. As a consequence, the effective surface of the shadow mask is so curved as to be turned. Thus, the shadow mask can not be easily manufactured.

Generally, a phosphor screen for used in color cathode-ray tubes is manufactured by photolithography. To be more specific, first, a phosphor slurry made of mainly blue-emitting phosphor and photosensitive resin is coated on the inner surface of the panel and subsequently dried, forming a phosphor layer. Then, the phosphor layer is exposed to the light beams applied through the shadow mask. The layer, thus light-exposed, is developed, forming blue-emitting phosphor stripes on the inner surface of the panel. The sequence of these steps are repeated for two phosphor slurries containing green-emitting phosphor and red-emitting phosphor, respectively, thereby forming green-emitting phosphor stripes and red-emitting phosphor stripes on the inner surface of the panel.

In the step of exposing each phosphor layer, light beams are applied from a light source to the shadow mask through an optical lens system in the same paths as electron beams will be applied from the electron gun to the shadow mask. The light beams passing through the apertures of the shadow mask are applied onto each phosphor layer formed on the inner surface of the panel. The phosphor stripes formed by developing the phosphor layer therefore assume specific positional relation with the apertures of the mask. An in-line color cathode-ray tube has a phosphor screen consisting of blue-, green- and red-emitting phosphor stripes formed on the inner surface of the panel, black stripes arranged between the phosphor stripes, and a shadow mask having vertical arrays of elongated apertures. Even if the spot an electron beam passing through one of the apertures forms on the target phosphor stripe moves in the lengthwise direction of the stripe (namely, along the short axis Y of the phosphor screen), the color purity will not affected. Therefore it is unnecessary to apply light beams to the shadow mask in the substantially same paths as the electron beams emitted from the electron gun to the shadow mask. To form a phosphor screen in the in-line color cathode-ray tube, an elongated light source is used which extends along the aperture arrays made in the shadow mask. The elongated light source serves to greatly shorten the exposure time and to form a phosphor-stripe pattern with high precision.

A problem will arise if an elongated light source is used. The inner surface of the panel is curved along not only the long axis X, but also the short axis Y. Thus, as shown in FIGS. 6 and 7, the light beams Ep emitted from the ends AL and BL of the light source Ls pass through the apertures of the shadow mask 6, reaching points AP and BP on the inner surface of the panel 2. The points AP and BP are spaced apart in horizontal direction by a distance Δ1, because the axis of the light source Ls and the axes of aperture arrays do not exist in the same plane. Consequently, although the phosphor stripes 16B, 16G and 16R provided on the central part of the panel 2 are straight as desired, as is illustrated in FIG. 8A, the phosphor stripes 16B, 16G and 16R are bent zigzag on the four edge parts of the panel 2, as is shown in FIG. 8C. The zigzagging of the stripes, known as "light-source bending," lowers the quality of the edge parts of the phosphor screen.

In order to prevent a decrease in the quality of the phosphor screen, a shutter is used in the step of exposing each inner phosphor layer to light beams. That is, a movable shutter having a window is located between the panel and the shadow mask, preventing the entire phosphor layer from being exposed to light at the same time. When the shutter is moved, the elongated light source is inclined, so that the axis of the aperture pattern formed on the phosphor layer may be in the same plane as the axis of the elongated light source. This exposure method requires a complex exposure device and a long exposure time. Recently, a new method is widely employed, in which an optical lens system adjusts the path of the light beams applied from the elongated light source, applying the beams onto the entire phosphor layer at a time, without inclining the elongated light source. The phosphor stripes formed by the new exposure method are bent zigzag, though slightly, on the four edge parts of the panel, because an optical lens system is used.

U.S. Pat. No. 4,691,138 (KOUKOKU Publication No. 5-1574) discloses two shadow masks which serve to form phosphor stripes which extend straight even on the four edge parts of the panel.

As shown in FIG. 9A, the first mask has aperture arrays 18 made in its effective part 5. Of the apertures made in the section extending for one-fourth the width W of the effective part 5 from either short side thereof, those located near either long side of the effective part are not inclined at angles PI of positive values as indicted by the curve I shown in FIG. 9B. Further, of these apertures, those located near an intermediate line 19 spaced from either long side of the effective part 5 by one-third the height H thereof are inclined at angles KII of negative values, as is indicated by the curve II shown in FIG. 9C. As shown in FIG. 10A, the second mask has aperture arrays 18 made in its effective part 5. Of the apertures made in the section defined above, those located near either long side of the effective part are inclined at various angles PI as indicated by the curve I shown in FIG. 10B. Of these apertures, those located near an intermediate line 19 defined above are inclined at various angles PII as indicated by the curve II shown in FIG. 10C.

In either shadow mask disclosed in U.S. Pat. No. 4,631,441, the apertures made in each corner section of the effective part 5 are not inclined sufficiently to prevent the forming of zigzag phosphor stripes.

SUMMARY OF THE INVENTION

An object of the present invention is to provide a color cathode-ray tube in which the shadow mask has aperture arrays juxtaposed at appropriate intervals and is curved to suppress a local doming of the effective part, and to prevent electron-beam mislanding from occuring on the phosphor screen.

Another object of the invention is to provide a color cathode-ray tube in which the apertures of each array made in the shadow mask are inclined such that the phosphor stripes formed on the panel extend straight even on the four edge parts of the panel, and which can therefore display images having high color purity.

According to an aspect of the invention, there is provided a color cathode-ray tube which comprises a panel having a substantially rectangular effective part, a phosphor screen provided on the inner surface of the effective part of the panel, and a shadow mask having a curved, substantially rectangular effective part facing the phosphor screen and having a number of apertures. The apertures are arranged, forming a plurality of arrays which extend along the short axis of the effective part and Juxtaposed along the long axis of the effective part. The distance PH(N) between the (N−1)th and Nth arrays, counted from the array passing the center O of the effective part, is given as:

$$PH(N)=A+BN^2+CN^4$$

where A, B and C are fourth-degree functions of a Y-coordinate in a coordinate system whose origin is the center O of the effective part and whose axes are the horizontal and vertical axes of the effective part, and C is a function first decreasing and then increasing as the absolute value of the Y-coordinate.

The distance PH(N) between the (N−1)th and Nth arrays, which are spaced about one-third the width W of the screen from the short axis of the screen, may increase with the absolute value of the Y-coordinate and may be represented by a fourth-degree function of the Y-coordinate so as to have a transition point in the effective part with respect to the short axis of the effective part.

Since the distance between any two adjacent aperture arrays is so set, the distance PHM2 between the two adjacent aperture array measured at a point M2 which is located in a distance of one-fourth the height H of the effective part of the mask from the long axis X of the mask as shown in FIG.

5 can be longer than the distance PHM1 between the two adjacent aperture arrays measured at a point M1 which is located on the long axis X of the shadow mask. Moreover, the distance PHM3 between the adjacent aperture arrays, measured at a point M3 located above the point M2 as shown in FIG. 5, can be shorter than in the case where the distance between any two adjacent aperture arrays changes as a quadratic function of the distance Y from the long axis X of the effective part. The distance PH between any two adjacent aperture arrays changes as a fourth-degree function of the distance Y. Thus, the distance PHM3 can be sufficiently short even if the distance PHM2 is longer than the distance PHM1. A desired part of the effective part can therefore be curved along the short axis at a radium of curvature small enough to reduce the local doming of the shadow mask. As a result, the electron-beam mislanding on the phosphor screen can be minimized.

According to another aspect of the invention, there is provided a color cathode-ray tube which comprises a panel having a substantially rectangular effective part, a phosphor screen provided on the inner surface of the effective part of the panel, and a shadow mask having a curved, substantially rectangular effective part facing the phosphor screen and having a number of elongated apertures. The elongated apertures are arranged, forming arrays which extend along the short axis of the effective part and which are juxtaposed along the long axis of the effective part. The aperture arrays are curved in different ways. The elongated apertures are inclined at different angles to the short axis of the effective part. More precisely, of the apertures made in the section extending for one-fourth the width of the effective part from either short side thereof, those located near either long side of the effective part are more inclined than those located near the long axis of the effective part. For the apertures made in the section extending for one-third the height of the effective part from either long side thereof, the angle changes from the short axis of the effective part toward either short side thereof, first increasing gradually to a maximum positive value and then decreasing to 0° or to a negative value.

The position each elongated aperture assumes in the effective part is represented by coordinates (x, y) in a coordinate system whose origin is the center of the effective part and whose axes are the long axis X and short axis Y of the effective part, where x is a fourth-degree function or a higher-degree function of y. Thus, the apertures made in any corner of the effective part are more inclined than those made in any other portion of the effective part. An elongated light source used to from the phosphor screen can therefore be located, with its axis existing in the same plane as the axis of the aperture pattern formed on the inner surface of the panel. Hence, the phosphor stripes formed are not bent zigzag, even on the four edge parts of the panel. Furthermore, since the inclination angle of the apertures made in the section extending for one-third the height of the effective part from either long side thereof changes from the short axis of the effective part toward either short side thereof, first increasing gradually to a maximum positive value and then decreasing to 0° or to a negative value, the aperture arrays provided in this section are spaced apart by a long distance. On the other hand, the aperture arrays are spaced apart by a short distance along the long axis of the effective part, whereby the local doming of this section is suppressed sufficiently, whereby the cathode-ray tube can display images having high color purity.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Embodiments of the present invention, which are color cathode-ray tubes, will be described in detail with reference to the accompanying drawings.

Figure 11:
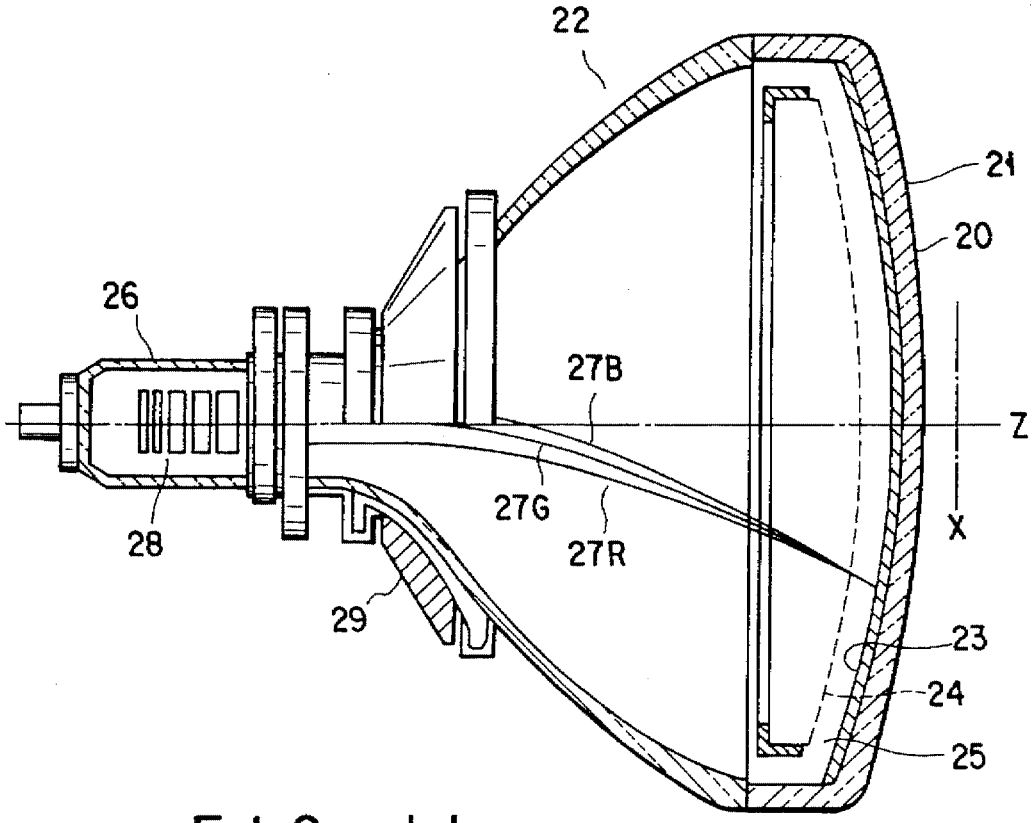
FIG. 11 is a sectional view of a color cathode-ray tube according to a first embodiment of the present invention.

FIG. 11 shows a color cathode-ray tube according to the first embodiment of the invention. As shown in FIG. 11, the cathode-ray tube comprises a panel 21, a funnel 22, a phosphor screen 23, a shadow mask 25, an electron gun 28, and a beam-deflecting unit 29. The panel 21 and the funnel 22 are connected together, forming an envelope. The phosphor screen 23 is provided on the inner surface of the effective part 20 of the panel 21. The screen 23 consists of blue-emitting phosphor layers, green-emitting phosphor layers and red-emitting phosphor layers. The shadow mask 25 is provided in the envelope and faces the phosphor screen 23. The mask 25 has an effective part 24 which is substantially rectangular. The effective part 24 is curved and has apertures. The electron gun 28 is provided in the neck 26 of the funnel 22, for emitting three electron beams 27B, 27G and 27R. The beam-deflecting unit 29 is located outside the envelope, more precisely mounted on the funnel 22. In operation, the beams 27B, 27G and 27R emitted from the gun 28 are deflected in horizontal and vertical planes, pass through the apertures of the shadow mask 25, and are applied onto the phosphor screen 23, whereby the cathode-ray tube displays a color image.

Figure 12:
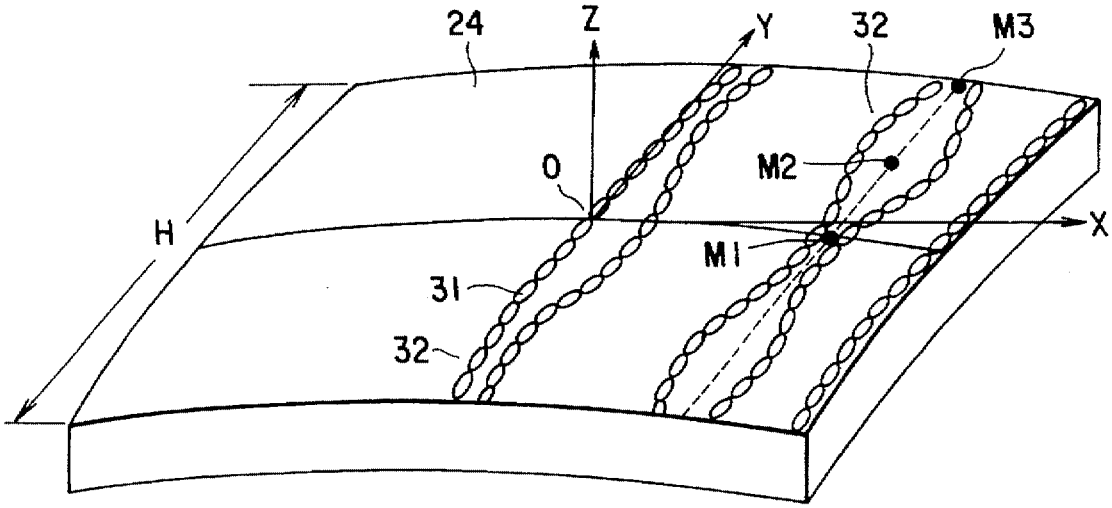
FIG. 12 is a perspective view of the shadow mask incorporated in the cathode-ray tube shown in FIG. 11.

As shown in FIG. 12, the apertures 31 are arranged in a plurality of arrays 32, which extend almost parallel to the short axis Y of the shadow mask 25 and are juxtaposed along the long axis X of the shadow mask 25. The distance PH(N) between the (N−1)th and Nth arrays 32, counted from the array 32 passing the center O of the effective part 24, is given as:

$$PH(N)=A+BN^2+CN^4$$

where A, B and C are fourth-degree functions of a Y-coordinate in a coordinate system whose origin is the center O of the effective part and whose axes are the horizontal and vertical axes of the effective part, and C is a function first decreasing and then increasing as the absolute value of the Y-coordinate. The values for A and B change with C such that the effective part 24 remains substantially rectangular.

Figure 13:
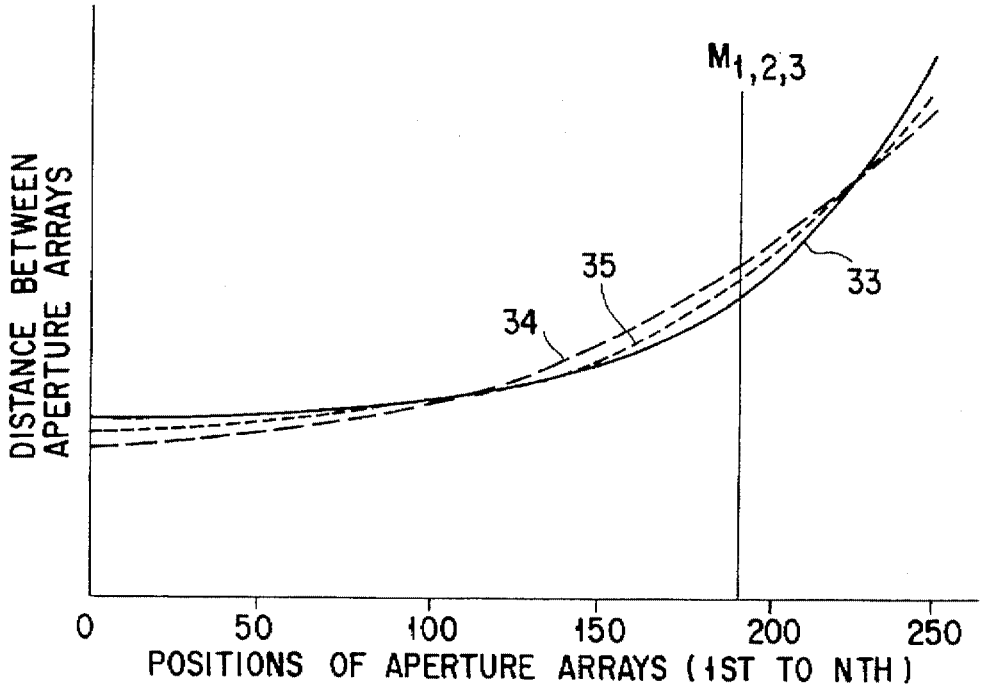
FIG. 13 is a graph representing how much the aperture arrays are spaced apart along the long axis X and long side of the effective part of the shadow mask shown in FIG. 12 and along an intermediate line extending between the long axis X and long side of the effective part.

Assume that the shadow mask 25 has 500 aperture arrays that 250 aperture arrays are juxtaposed on each side of the short axis Y, from the center O of the effective part 24 toward the left or right edge. FIG. 13 shows the relations N and PH(N) have along the long axis X. To be more specific, curve 33 shows the relation which N and PN(N) have along the long axis X of the effective part 24; curve 34 the relation which N and PH(N) have along the intermediate line extending parallel to the long side of the effective part 24 and spaced therefrom by one-fourth the height H' of the effective part 24; and curve 35 the relation which N and PH(N) have along the long side of the effective part 24.

Figure 4:
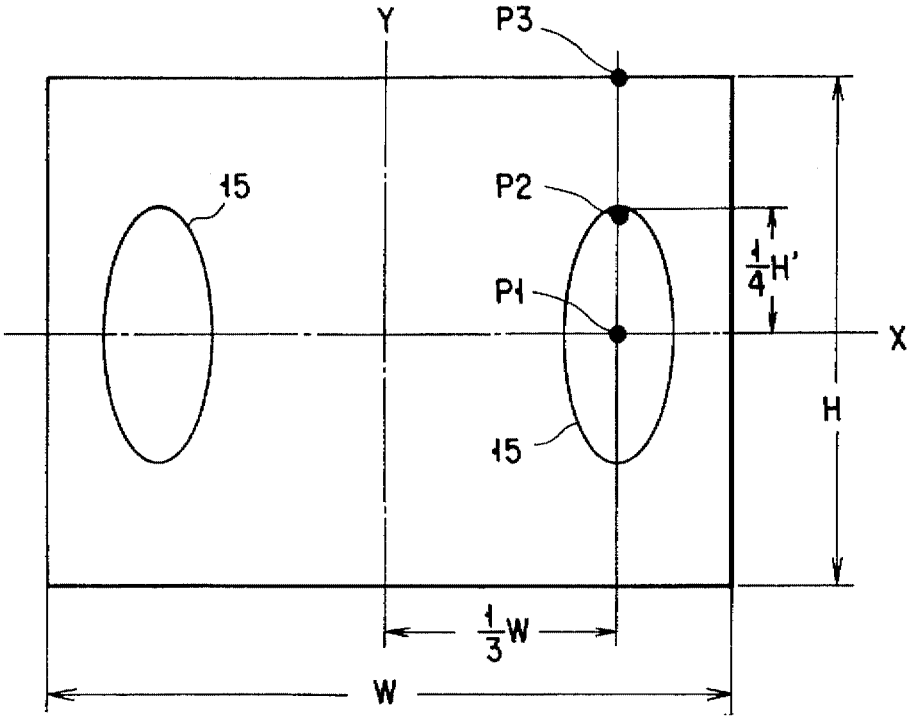
FIG. 4 (PRIOR ART)
FIG. 4 is a diagram showing the region of the phosphor screen, where the electron-beam mislanding occurs due to the local doming of the shadow mask shown in FIG. 3.

The curves 33, 34 and 35 shown in FIG. 13 indicate that as Y increases, the C of $CN^4$ changes differently along the long axis X of the effective part 24, the intermediate line between the long axis X and long side of the effective part 24 and the long side of the effective part 24. As curves 33 and 34 show, the C of $CN^4$ decreases as Y increases. The curves 33 and 34 also teach that the distance PH(190M2) by which the 189th and 190th aperture arrays are spaced apart at point M2 (FIG. 5) on the intermediate line is longer than the distance PH(190M1) by which these two adjacent aperture arrays are spaced apart at point M1 (FIG. 5) at which an electron beam passes through the mask 25 before reaching point P1 (FIG. 4) located in the long axis X of the screen 23 and at one-third the width W of the screen 23 from the short axis Y of the screen 23. As the distance Y increases, the fourth-degree function C of N increases. As can be understood from the curve 35, the distance PH(190M3) is shorter than the distance PH(190M2). It is by the distance PH(190M3) that the 189th and 190th aperture arrays are spaced apart at point M3 (FIG. 5) on the long side, at which an electron beam passes through the mask 25 before reaching point P3 (FIG. 4).

Namely, the distance PH between the 189th and 190th aperture arrays of the shadow mask 25, which are spaced about one-third the width W of the screen 23 from the short axis Y of the screen 23, have values PH(190M1), PH(190M2) and PH(190M3) which have the following relationship:

$$PH(190M2)>PH(190M3)>PH(190M1)$$

Figure 14:
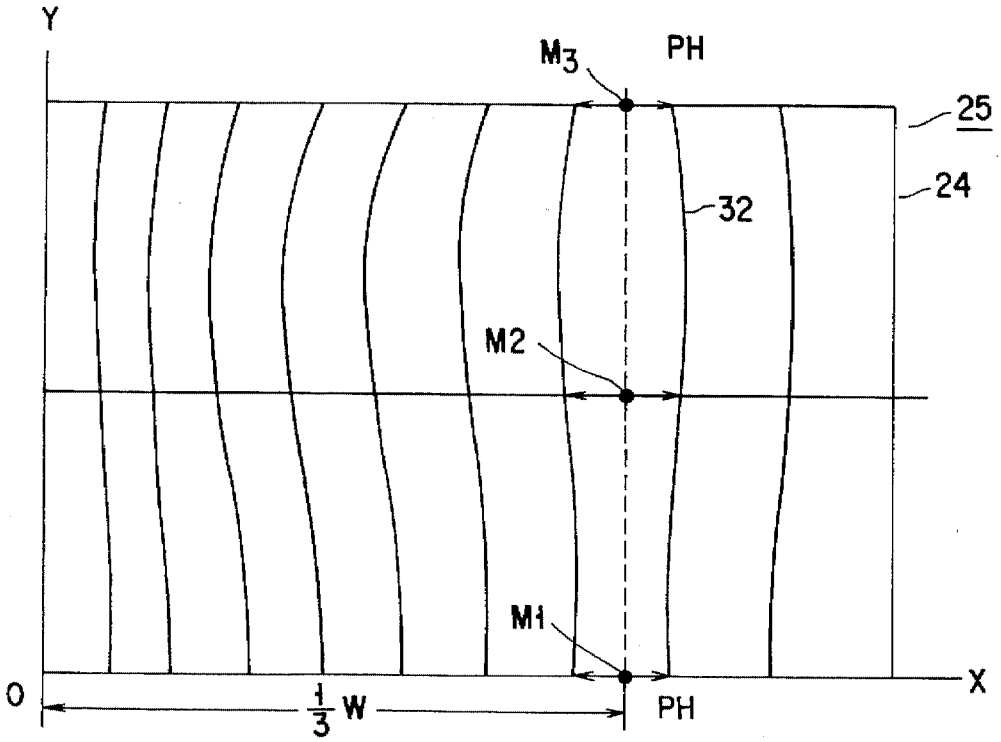
FIG. 14 is a diagram showing the arrangement of the aperture arrays made in the shadow mask shown in FIG. 12.

FIG. 14 schematically illustrates the arrangement of the aperture arrays made in the upper-right section (the first quadrant) of the effective part 24 of the shadow mask 25. In this section of the effective part 24, most aperture arrays extend along the curves which are fourth-degree functions of the distance Y, and some aperture arrays close to the right edge of the effective part 24 extend almost straight. That is,the effective part 24 is substantially rectangular. The distance PH between the 189th and 190th aperture arrays provided in that portion of the mask 25, where a local doming will most likely occur to cause electron-beam mislanding on the phosphor screen 23, gradually increases from the point M1 on the long axis X of the effective portion 24 toward the point M2. Then, the distance PH gradually decreases from the point M2 toward the point M3 on the long side of the effective part 24.

Figure 15A:
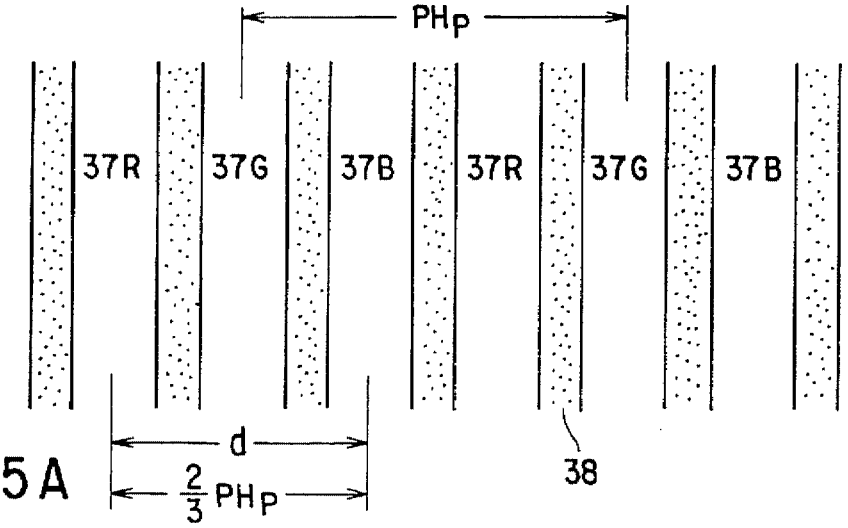
FIGS. 15A, 15B and 15C are diagrams, each showing a relation among the distance between the shadow mask and the inner surface of the panel, the distance between any two adjacent aperture arrays, and the distance between any two adjacent phosphor stripes.

A method of minimizing the electron-beam mislanding due to the local doming of the shadow mask 25 will be explained. As described above, the three electron beams must correctly land on blue-emitting, green-emitting and red-emitting phosphor stripes in order to display an image having a sufficient color purity on the phosphor screen 23 which is provided on the effective part of the panel 21. To accomplish correct electron-beam landing, the distance q between the effective part 24 of the mask 24 and the effective part of the panel 20 needs to have an appropriate relation with the distance PH between any two adjacent aperture arrays 32. More specifically, the distance q and the distance PH should have such a relation that the distance d between, for example, a red-emitting phosphor stripe 37R and the adjacent blue-emitting phosphor stripe 37B is two-thirds the distance PHP between the adjacent green-emitting phosphor stripes 37G as is illustrated in FIG. 15A.

Figure 15B:
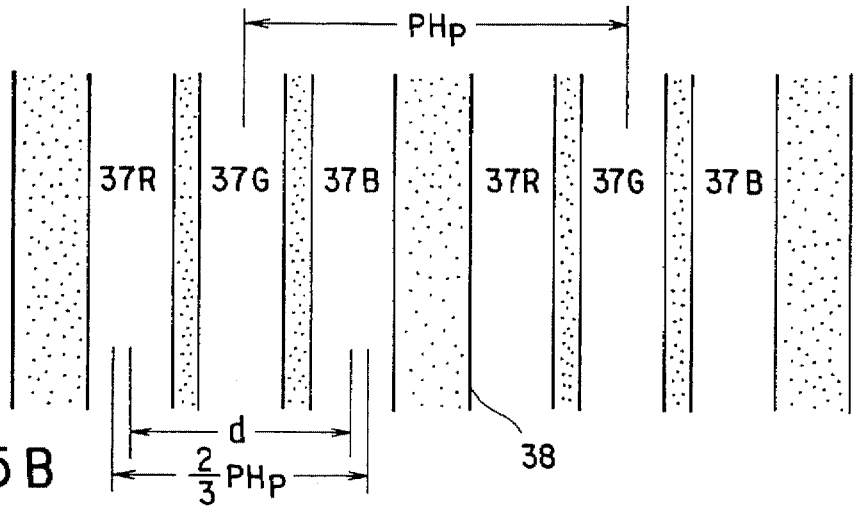
Figure 15C:
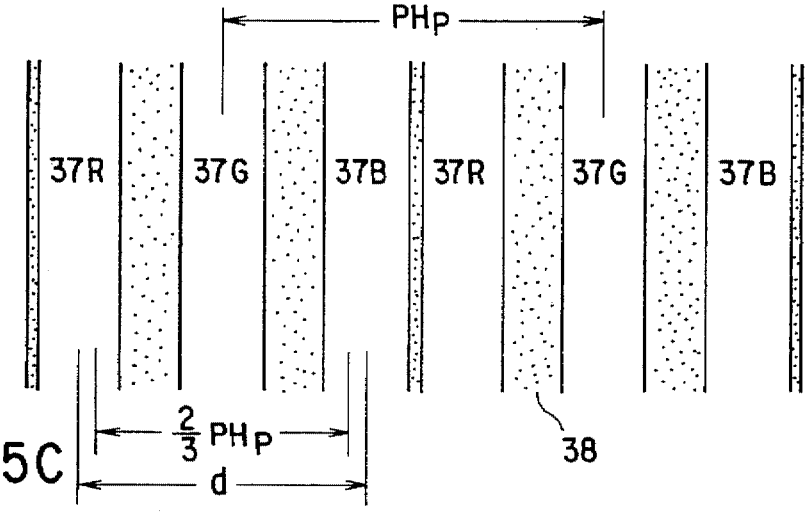

If the distance q is less than the proper value, d will be less than two-thirds of the distance PHP as shown in FIG. 15B—that is, $d<\frac{2}{3}$ PHP. In this case, it is necessary to increase the distance q or decrease the distance PHP. On the other hand, if the distance q is greater than the proper value, d will be greater than two-thirds of the distance PHP as shown in FIG. 15C—that is, $d>\frac{2}{3}$ PHP, and it is necessary to decrease the distance q or increase the distance PHP. As shown in FIGS. 15A, 15B and 15C, light-absorbing stripes 38 are provided among the phosphor stripes 37B, 37G and 37R.

As indicated above, the distance PH(190M2) is longer than the distance PH(190M1). It is by the distance PH(190M2) that the 189th and 190th aperture arrays are spaced apart along the intermediate line between the long axis X and long side of the effective part 24. It is by the distance PH(190M1) that the 189th and 190th aperture arrays are spaced apart along the long axis X of the effective part 24. Hence, the distance q may be increased to impart an appropriate relation to the distance q and the distance PH.

Figure 1:
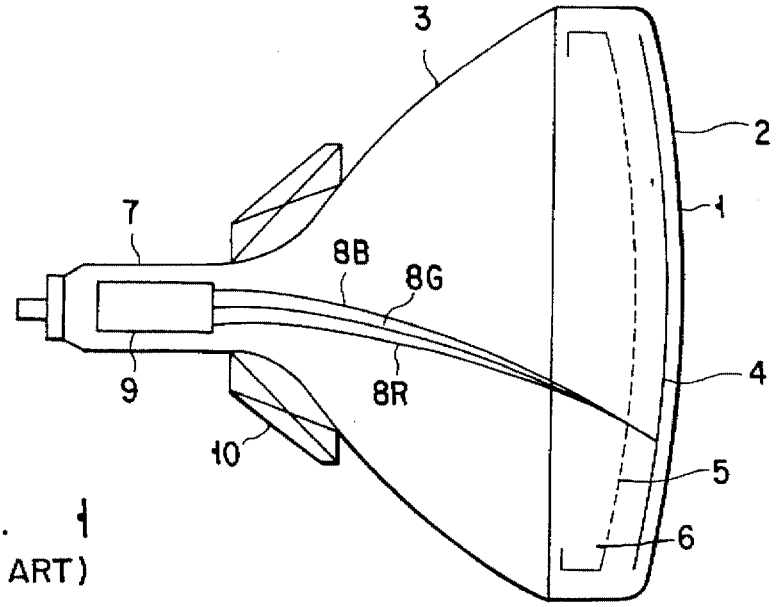
FIG. 1 (PRIOR ART)
FIG. 1 is a sectional view of a conventional color cathode-ray tube.
Figure 2:
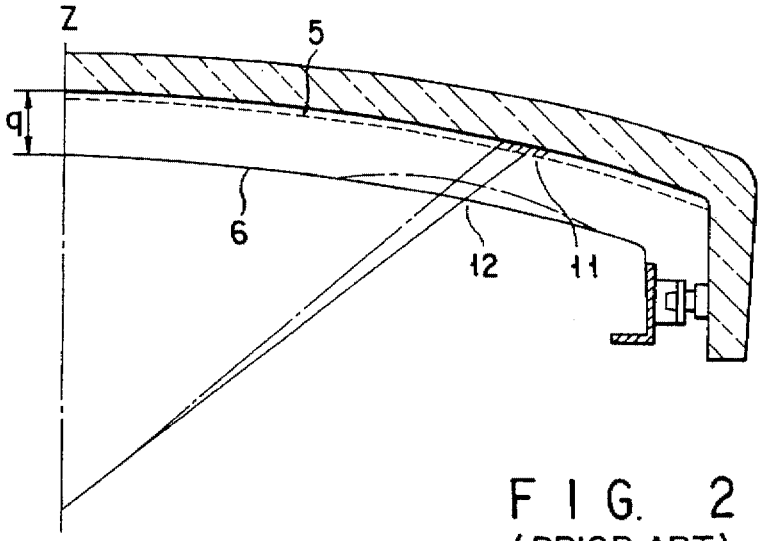
FIG. 2 (PRIOR ART)
FIG. 2 is a diagram explaining the electron-beam mislanding which occurs in the cathode-ray tube shown in FIG. 1, due to the doming of the shadow mask.
Figure 3:
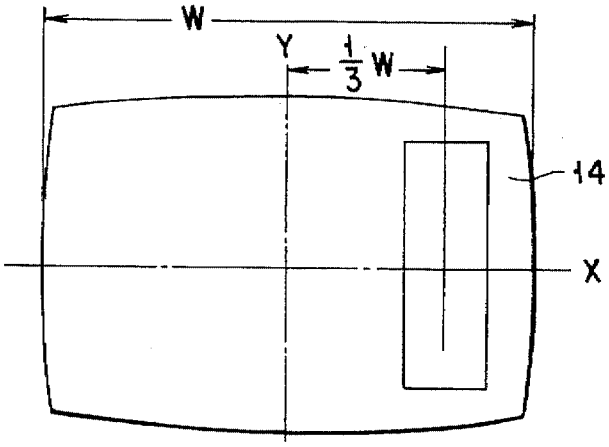
FIG. 3 (PRIOR ART)
FIG. 3 is a diagram explaining how a local doming of the shadow mask takes place in the cathode-ray tube shown in FIG. 1.
Figure 5:
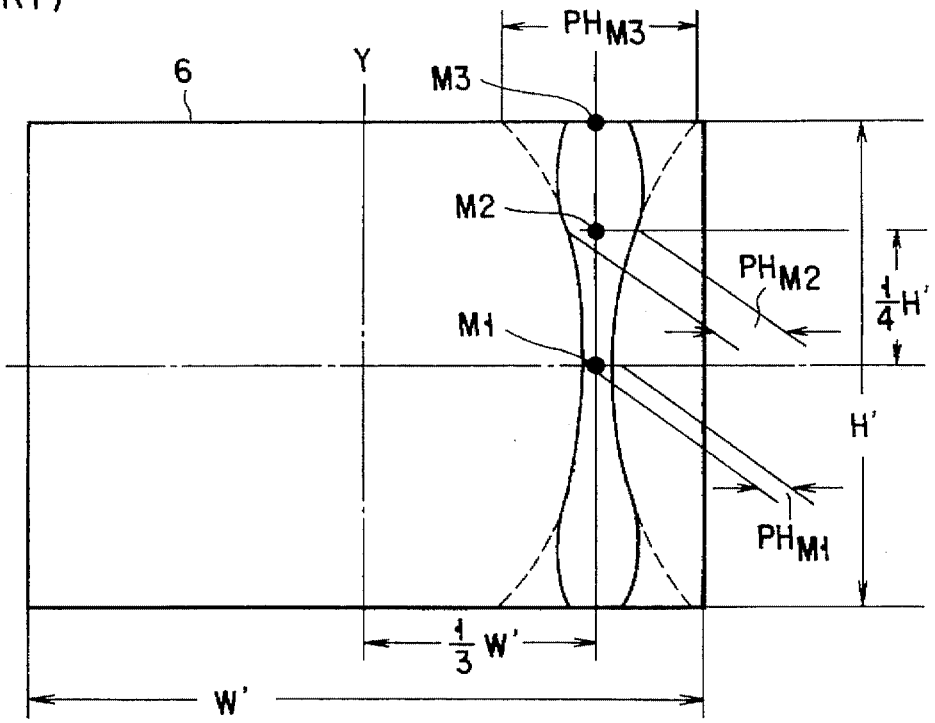
FIG. 5 (PRIOR ART)
FIG. 5 is a diagram explaining the problem with a conventional shadow mask in which the distance between any two adjacent aperture arrays increases as a quadratic function of the distance Y from the long axis X of the effective part.
Figure 6:
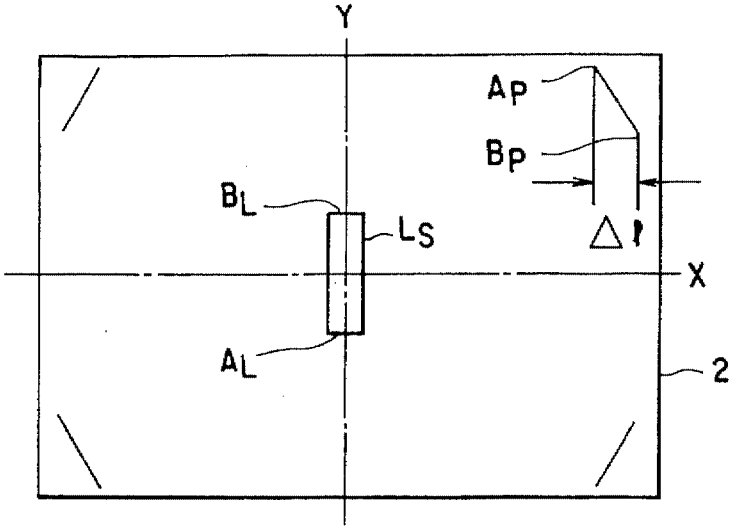
FIG. 6 (PRIOR ART)
FIG. 6 is a diagram explaining why the phosphor stripes are bent zigzag on the four edge parts of the panel in a conventional color cathode-ray tube.
Figure 7:
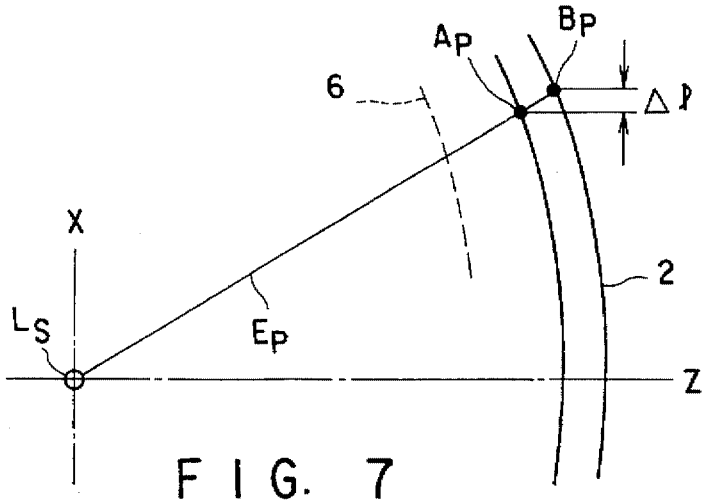
FIG. 7 (PRIOR ART)
FIG. 7 is another diagram explaining why the phosphor stripes are bent zigzag on the four edge parts of the panel in the conventional color cathode-ray tube.
Figure 8B:
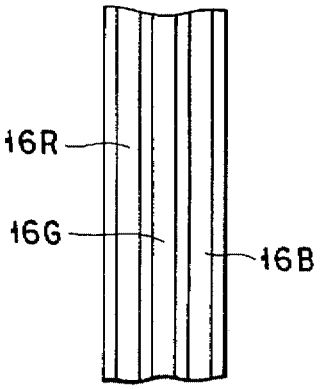
FIG. 8B (PRIOR ART)
FIG. 8B is a diagram showing the shape of the phosphor stripes formed on the central part of the panel.
Figure 8C:
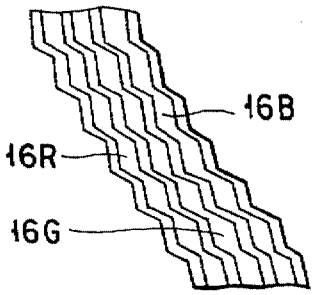
FIG. 8C (PRIOR ART)
FIG. 8C is a diagram illustrating the shape of the phosphor stripes formed on the four edge parts of the panel.
Figure 8A:
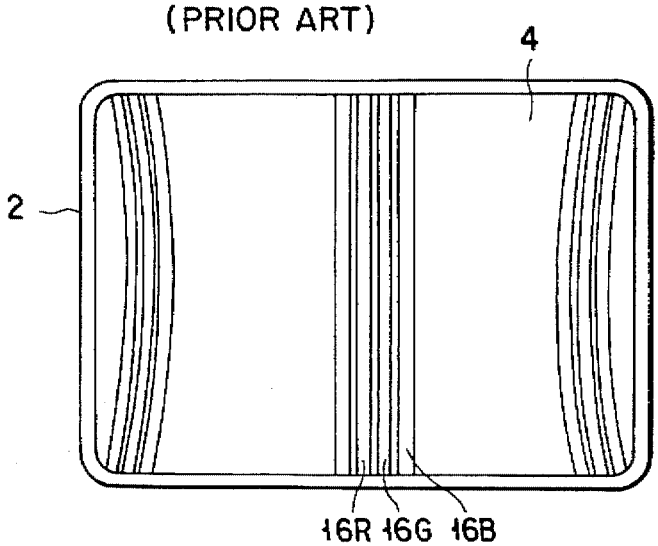
FIG. 8A (PRIOR ART)
FIG. 8A is a plan view of the phosphor screen of the conventional color cathode-ray tube.
Figure 9A:
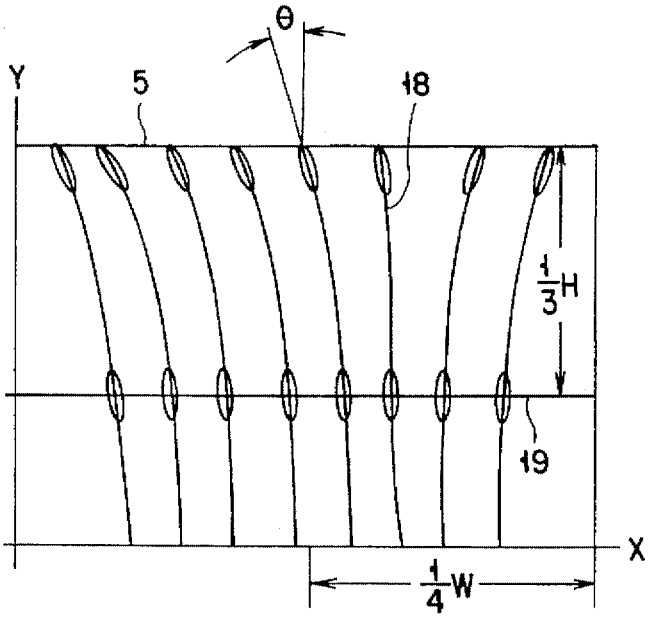
FIG. 9A (PRIOR ART)
FIG. 9A is a diagram showing the aperture arrays made in a conventional shadow mask.
Figure 9B:
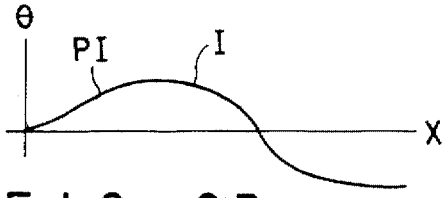
FIG. 9B (PRIOR ART)
FIG. 9B is a graph representing how much the apertures arranged along the long side of the conventional shadow mask are inclined to the short axis Y of the mask.
Figure 9C:
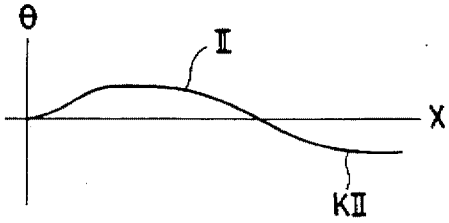
FIG. 9C (PRIOR ART)
FIG. 9C is a graph representing how much the apertures arranged along an intermediate line spaced from the long side of the mask by one-third the height of the effective part of the mask are inclined to the short axis Y of the conventional shadow mask.
Figure 10A:
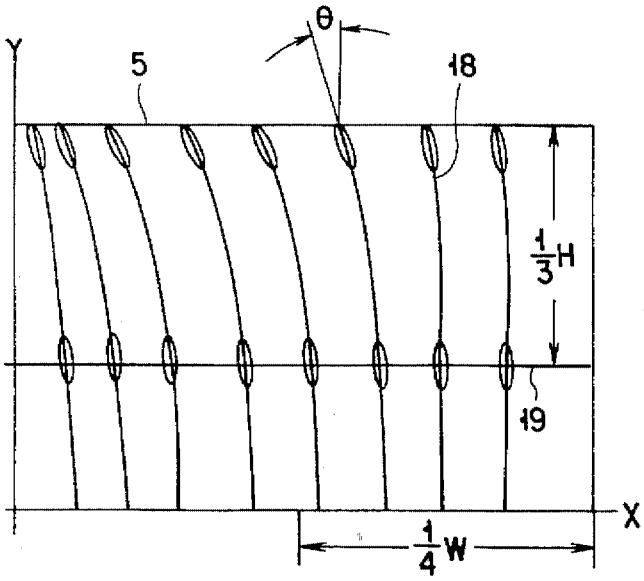
FIG. 10A (PRIOR ART)
FIG. 10A is a diagram showing the aperture arrays made in another conventional shadow mask.
Figure 10B:
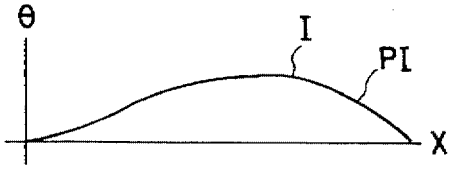
FIG. 10B is a graph representing how much the apertures arranged along the long side of the mask shown in FIG. 10A are inclined to the short axis of the mask.
Figure 10C:
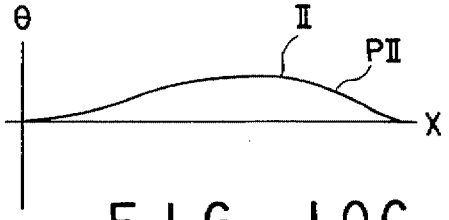
FIG. 10C (PRIOR ART)
FIG. 10C is a graph representing how much the apertures arranged along an intermediate line spaced from the long side of the mask are inclined to the short axis Y of the shadow mask.
Figure 16:
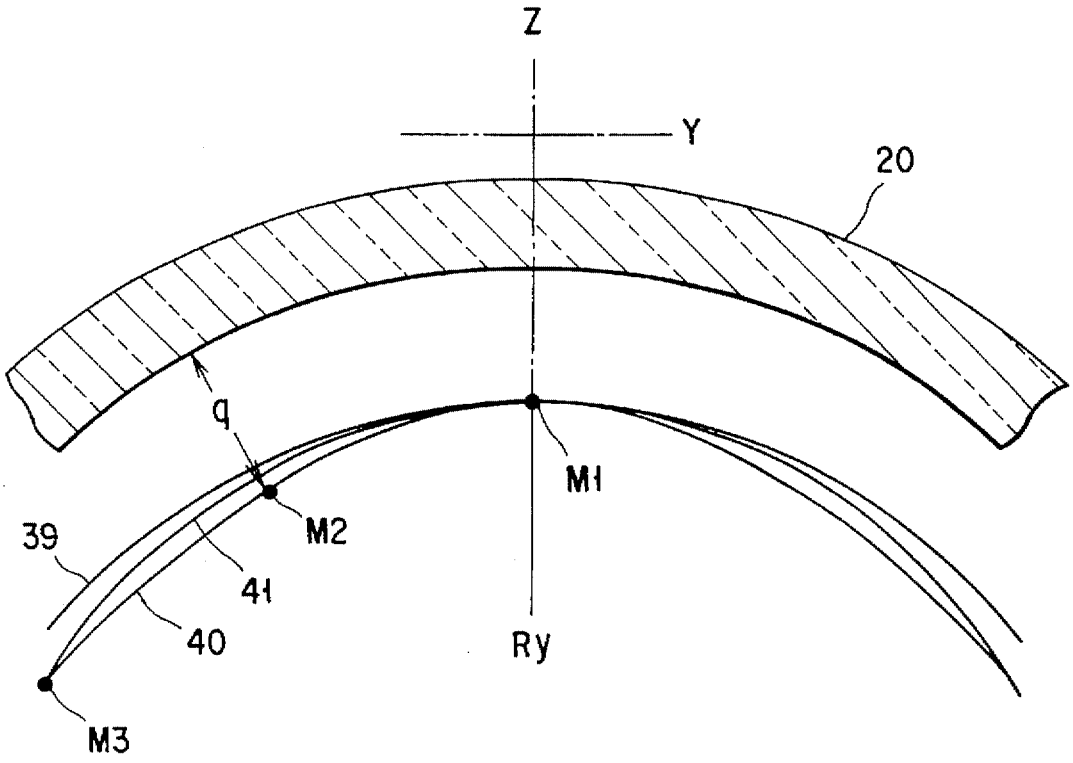
FIG. 16 is a diagram showing three curves along which the shadow mask shown in FIG. 12, a first conventional shadow mask and a second conventional shadow mask are curved along the short axis.

A conventional shadow mask (hereinafter referred to as "first conventional shadow"), which has aperture arrays juxtaposed along the long axis such that the distance PH between any two adjacent aperture arrays does not change along the short axis Y, is curved along a curve 39 shown in FIG. 16, as viewed in a Y-Z plane containing the point M1 (FIG. 5). The conventional shadow mask 6 shown in FIG. 2 (hereinafter referred to as "second conventional mask") which has aperture arrays juxtaposed along the long axis such that the distance PH between any two adjacent aperture arrays changes as a quadratic function of the distance Y from the long axis X, is curved along a curve 41 shown in FIG. 16, as viewed in a Y-Z plane containing the point M1 (FIG. 5). The second conventional mask can have a longer distance q at the points M2 and M3 (FIG. 5) than the shadow mask which is curved along a curve 39 as viewed in the Y-Z plane. The second conventional mask therefore has a curvature along the short axis Y, large enough to reduce its local doming to some extent. The value the distance PH has at the point M3 is much greater than the value it has at the point M2. To decrease the distance PH at the point M3 appropriately, the second conventional mask must be curved in the opposite direction. To avoid this, the distance PH at the point M2 needs to be relatively short.

In the shadow mask 25 shown in FIG. 12, most aperture arrays extend along the curves which are fourth-degree functions of the distance Y as described above. Thus, the mask 25 is curved along a curve 40 shown in FIG. 16, as viewed in a Y-Z plane containing the point M1 (FIG. 5). As can be understood from the curve 40, the distance PH(190M3) at the point M3 is as short as in the second conventional mask, even if the distance PH(190M2) at the point M2 is longer than in the second conventional mask. Therefore, the mask 25 need not be curved in two opposite direction along the short axis Y. Namely, the distance q can be sufficiently long at the point M2, i.e., along the intermediate line, while the distance q along the upper and lower edge is as long as in the second conventional shadow mask. As a result of this, the effective part 24 has a curvature large enough to suppress the mislanding of the electron beams passing through the effective part 24 even if the effective part 24 underwent local doming.

The radii Ry of curvature at which the first and second conventional masks and the shadow mask 25 are curved along the short axis Y are as shown in the following Table 1:

TABLE 1

| | 1st conventional mask | 2nd conventional mask | Shadow mask 25 |
|---|---|---|---|
| On short axis | 850 mm | 750 mm | 650 mm |
| On intermediate line | 850 mm | 750 mm | 800 mm |
| On long side | 850 mm | 750 mm | 2200 mm |

As seen from Table 1, the radius Ry of curvature at which the shadow mask 25 is curved along the short axis Y, on the long axis X is 23% less than the radius Ry of curvature of the first conventional mask and 13% less than the radius Ry of the second conventional mask. On the long side, the radius Ry of curvature of the shadow mask 25 is greater than that of the first conventional mask. Nonetheless the doming, if any, of the long side part of the shadow mask 25 is small since the mask frame holding this part has heat capacity large enough to absorbs the thermal energy which the mask 25 generates when impinged with electron beams. This helps to reduce the electron-beam mislanding, despite that the radius Ry of curvature of the mask 25 is relatively large. It has been found that the mislanding occurring in a color cathode-ray tube incorporating the shadow mask 25 is 14% less than the mislanding taking place in a color cathode-ray tube comprising the second conventional mask.

A color cathode-ray tube according to a second embodiment of the invention will be described, with reference to FIGS. 17 and 18.

In the embodiment shown in FIG. 14, the intervals between any two adjacent aperture arrays on the long axis X of the shadow mask are different from that on the long side of the rectangular shadow mask. However, in the embodiment shown in FIG. 18, the intervals between any two adjacent aperture arrays on the long axis X of the shadow mask are substantially same as that on the long side of the rectangular shadow mask. In FIG. 18, the aperture arrays 32 made in the effective part 24 of the shadow mask extend almost parallel to the short axis Y of the shadow mask and are juxtaposed along the long axis X of the shadow mask. The distance PH(N) between any two adjacent aperture arrays 32 is given as:

$$PH(N)=A+BN^2+CN^4$$

Figure 18:
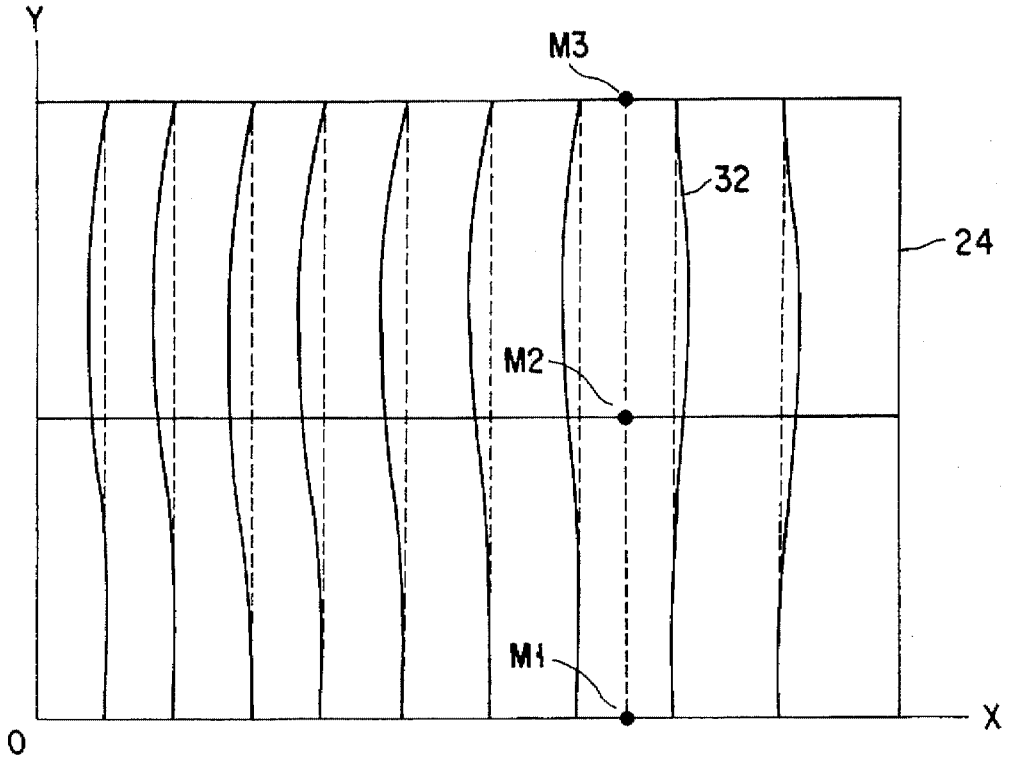
FIG. 18 is a plan view schematically showing the arrangement of the aperture arrays made in the shadow mask shown in FIG. 17.

The shadow mask of FIG. 18 is the same as the shadow mask 25 shown in FIG. 12, so far as this equation is concerned. However, the coefficients A, B and C have different values.

Figure 17:
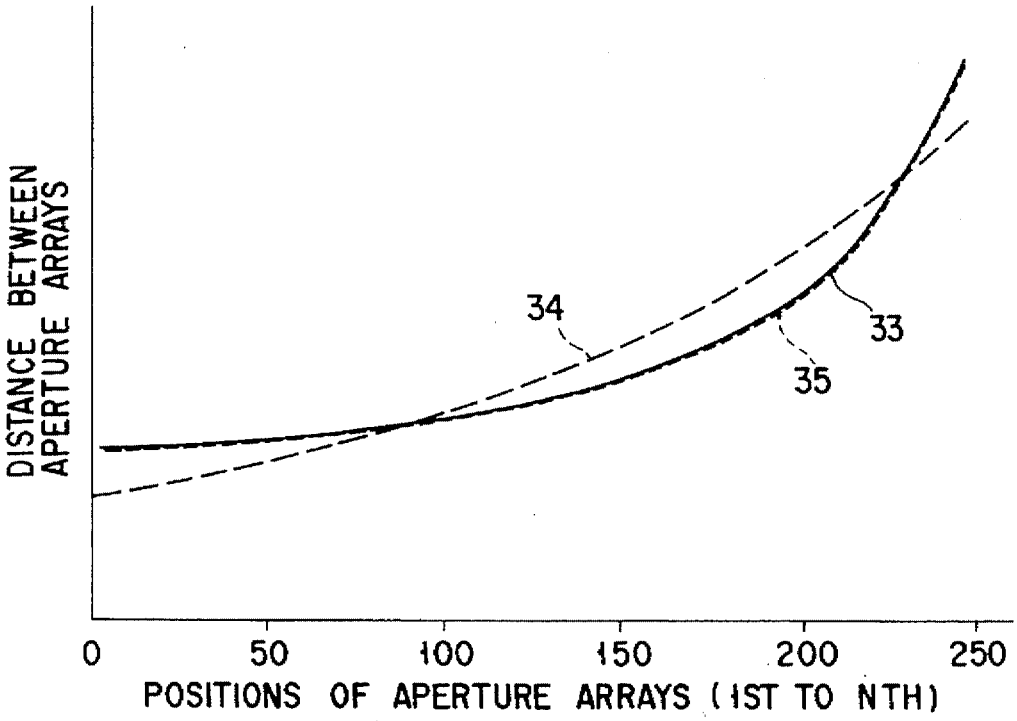
FIG. 17 is a graph representing how much the aperture arrays made in the effective part of a shadow mask used in a color cathode-ray tube according to a second embodiment of the invention are spaced apart along the long axis X and long side of the effective part and along an intermediate line extending between the long axis X and long side of the effective part.

In FIG. 17, a curve 33 shows how much the aperture arrays 32 are spaced apart along the long axis X of the effective part 24 of the mask, a curve 34 shows how much the aperture arrays 32 are spaced apart along an intermediate line extending between the long axis X and long side of the effective part 24, and a curve 35 illustrates how much the aperture arrays 32 are spaced apart along the long side of the effective part 24. The intermediate line is spaced from the long axis X by one-fourth the height H' of the effective part 24. As shown in FIG. 17, the curves 33 and 35 completely overlap. This means that any two adjacent aperture arrays are spaced apart by the same distance along the long axis X and the long side of the effective part 24.

FIG. 18 schematically illustrates the arrangement of the aperture arrays made in the upper-right section (the first quadrant) of the effective part 24 of the shadow mask. As clearly shown by broken lines, the distance PH(N) between any two adjacent aperture arrays 32 is equal on the long axis X and the long side of the effective part 24. As evident from the solid curves, the distance PH(N) is longer near a point M2 than near a point M1 at which an electron beam may pass through the mask before reaching a region of the phosphor screen, where the electron-beam mislanding is most prominent. It should be noted that the point M1 is on the long axis X, whereas the point M2 is on the intermediate line spaced from the axis X by one-fourth the height H' of the effective part 24.

The shadow mask having the aperture array arrangement shown in FIG. 18 achieves the same advantages as the shadow mask 25 incorporated in the first embodiment.

A color cathode-ray tube according to a third embodiment of the invention will be described, with reference to FIG. 19A to 20B.

Figure 19A:
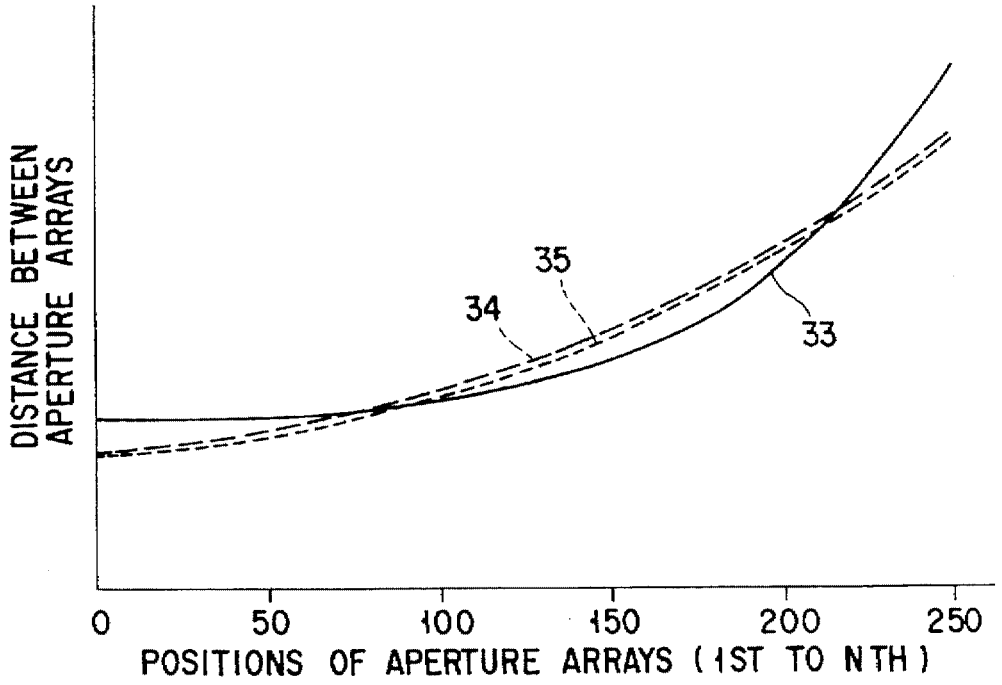
FIGS. 19A and 19B are diagrams representing how much the aperture arrays made in the effective part of a shadow mask incorporated in a color cathode-ray tube according to a third embodiment of the invention are spaced apart along the long axis X and long side of the effective part and along an intermediate line extending between the long axis X and long side of the effective part.

A shadow mask of the third embodiment of the invention has aperture arrays having an arrangement shown in FIG. 19A. In FIG. 19A, the distance PH(N) between any two adjacent aperture arrays 32 is given as:

$$PH(N)=A+BN^2+CN^4$$

The shadow mask of FIG. 19A is the same as the shadow mask 25 shown in FIG. 12, so far as this equation is concerned. However, the coefficients A, B and C have different values.

In FIG. 19A, a curve 33 shows how much the aperture arrays 32 are spaced apart along the long axis X of the effective part 24 of the mask, a curve 34 shows how much the aperture arrays 32 are spaced apart along an intermediate line extending between the long axis X and long side of the effective part 24, and a curve 35 illustrates how much the aperture arrays 32 are spaced apart along the long side of the effective part 24. The intermediate line is spaced from the long axis X by one-fourth the height H' of the effective part 24. As shown in FIG. 19A, the curves 34 and 35 completely overlap. This means that any two adjacent aperture arrays are spaced apart by the same distance along an intermediate line and the long side of the effective part 24.

Figure 20A:
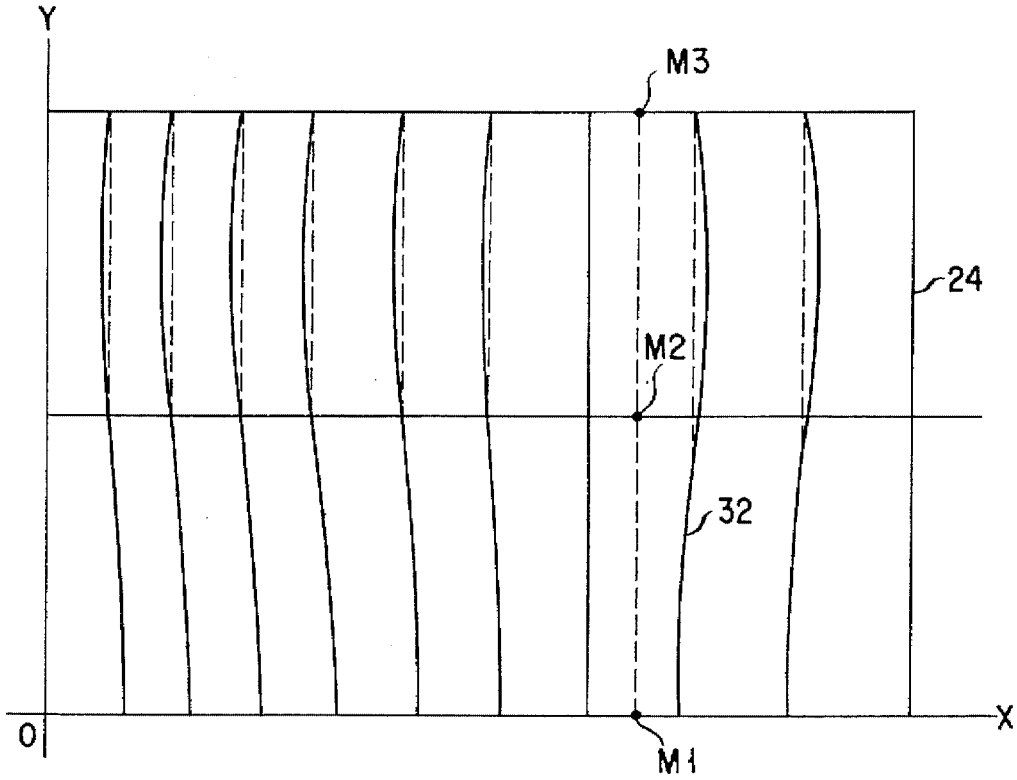
FIGS. 20A and 20B are plan views schematically showing the arrangement of the aperture arrays made in the shadow mask shown in FIGS. 19A and 19B, respectively.

FIG. 20A schematically illustrates the arrangement of the aperture arrays made in the upper-right section (the first quadrant) of the effective part 24 of the shadow mask. As clearly shown by broken lines, the distance PH(N) between any two adjacent aperture arrays 32 is equal on the intermediate axis and the long side of the effective part 24. As evident from the solid curves, the distance PH(N) is longer near a point M2 than near a point M1 at which an electron beam may pass through the mask before reaching a region of the phosphor screen, where the electron-beam mislanding is most prominent. It should be noted that the point M1 is on the long axis X, whereas the point M2 is on the intermediate line spaced from the axis X by one-fourth the height H' of the effective part 24.

The shadow mask having the aperture array arrangement shown in FIG. 19A achieves the same advantages as the shadow mask 25 incorporated in the first embodiment.

Figure 19B:
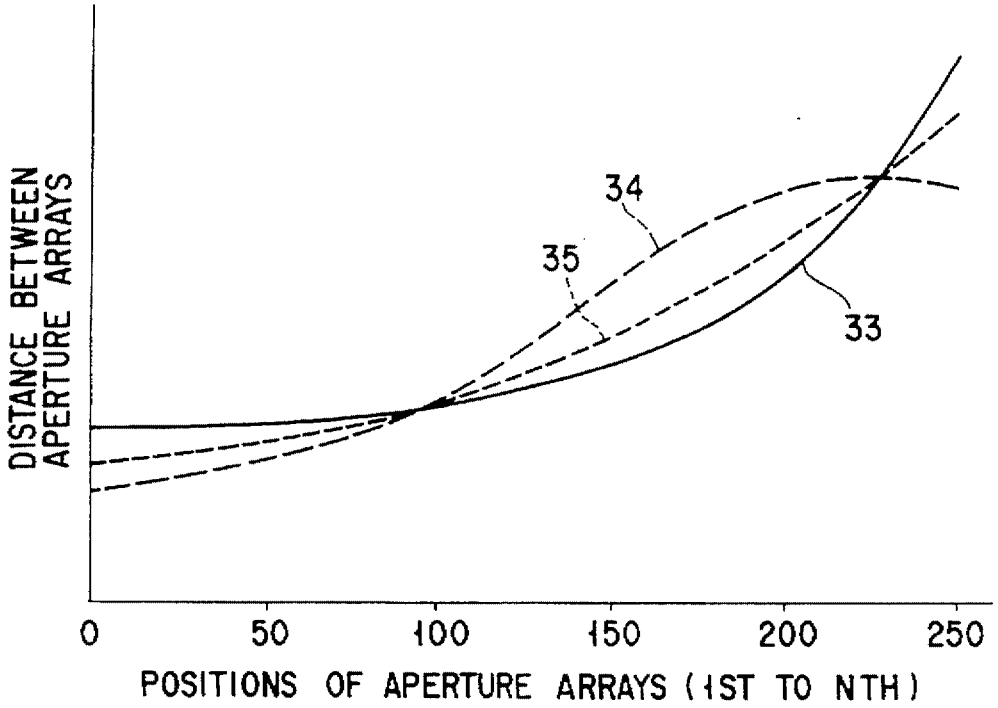

In the modification of the third embodiment, the shadow mask has an aperture array arrangement shown in FIG. 19B. In FIG. 19B, the distance PH(N) between any two adjacent aperture arrays 32 is given as:

$$PH(N)=A+BN^2+CN^4$$

The shadow mask of FIG. 19B is the same as the shadow mask 25 shown in FIG. 12, so far as this equation is concerned. However, the coefficients A, B and C have different values.

In FIG. 19B, a curve 33 shows how much the aperture arrays 32 are spaced apart along the long axis X of the effective part 24 of the mask, a curve 34 shows how much the aperture arrays 32 are spaced apart along an intermediate line extending between the long axis X and long side of the effective part 24 and spaced from the axis X by one-fourth the height H' of the effective part 24, and a curve 35 illustrates how much the aperture arrays 32 are spaced apart along the long side of the effective part 24. As the curve 34 shows, the distance PH(N) between any two adjacent aperture arrays located in an intermediate part of the effective part 24 first gradually increases from the short axis Y to the short side of the shadow mask and then gradually decreases from the intermediate part toward the short side of the effective part 24.

Figure 20B:
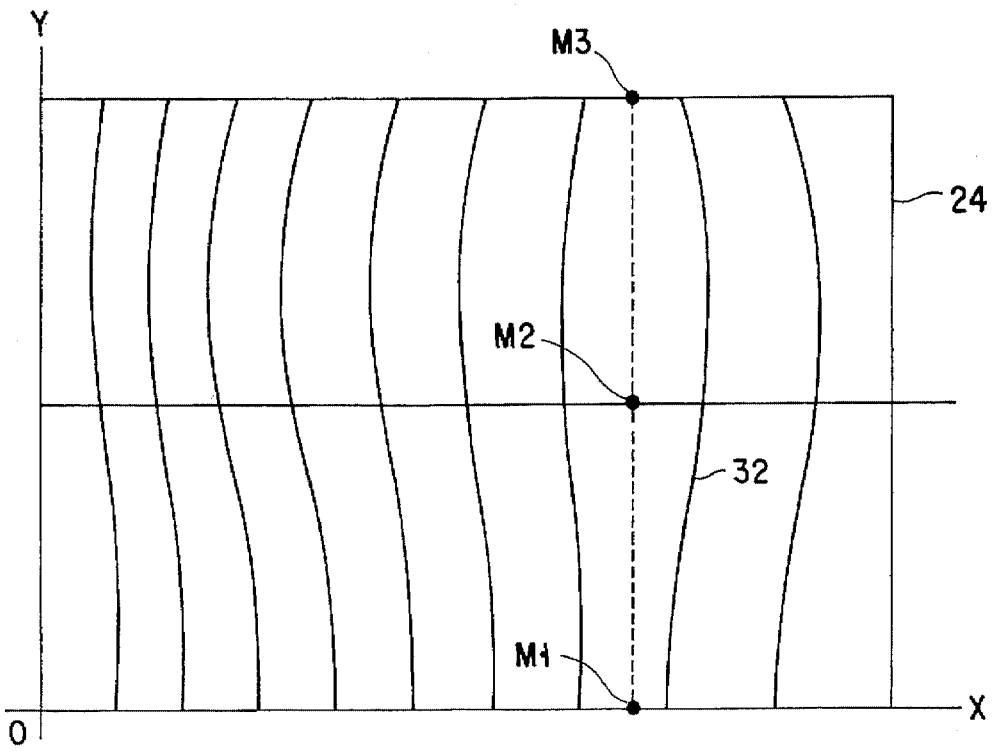

FIG. 20B schematically illustrates the arrangement of the aperture arrays made in the upper-right section (the first quadrant) of the effective part 24 of the shadow mask. As can be understood from FIG. 20B, the distance between any two adjacent aperture arrays 32 can be obtained under the condition in which the coefficient C in the term $CN^4$ of the above equation corresponding to the curve 34 is set to have a minus value.

Since the distance PH(N) between any two adjacent aperture arrays 32 changes along the long axis X of the effective part 24, the local doming is greatly reduced at that part of the shadow mask through which electron beams may pass before reaching the elliptical region 15 (FIG. 4) of the phosphor screen.

The present invention is not limited to the embodiments described above. Rather, it may be applied to any shadow mask in which the distance PH between any two adjacent aperture arrays 32 is given as $PH(N)=A+BN^2+CN^4$. Appropriate values can be selected for the coefficients A, B and C, thereby to minimize the local doming of the shadow mask.

As has been described, the present invention can provide a color cathode-ray tube which comprises a panel having a substantially rectangular effective part, a phosphor screen provided on the inner surface of the effective part of the panel, and a shadow mask having a curved, substantially rectangular effective part facing the phosphor screen and having a number of apertures. The apertures are arranged, forming a plurality of arrays which extend along the short axis of the effective part and juxtaposed along the long axis of the effective part. The distance PH(N) between the (N−1)th and Nth arrays, counted from the array passing through the center O of the effective part, is given as:

$$PH(N)=A+BN^2+CN^4$$

where A, B and C are fourth-degree functions of a Y-coordinate in a coordinate system whose origin is the center O of the effective part and whose axes are the horizontal and vertical axes of the effective part, and C is a function first decreasing and then increasing as the absolute value of the Y-coordinate.

The distance PH(N) between the (N−1)th and Nth arrays, which are spaced about one-third the width W of the screen from the short axis of the screen, may increase with the absolute value of the Y-coordinate and may be represented by a fourth-degree function of the Y-coordinate so as to have a transition point in the effective part with respect to the short axis of the effective part. In this case, the distance PH(N) can be optimized without altering the radium of curvature of the inner surface of the panel. The local doming of the shadow mask can therefore be reduced, suppressing the electron-beam mislanding on the phosphor screen. As a result, the color cathode-ray tube can display images having high color purity.

A color cathode-ray tube according to the fourth embodiment of the present invention will be described, with reference to FIGS. 21A to 21C and FIGS. 22 to 24.

Figure 21A:
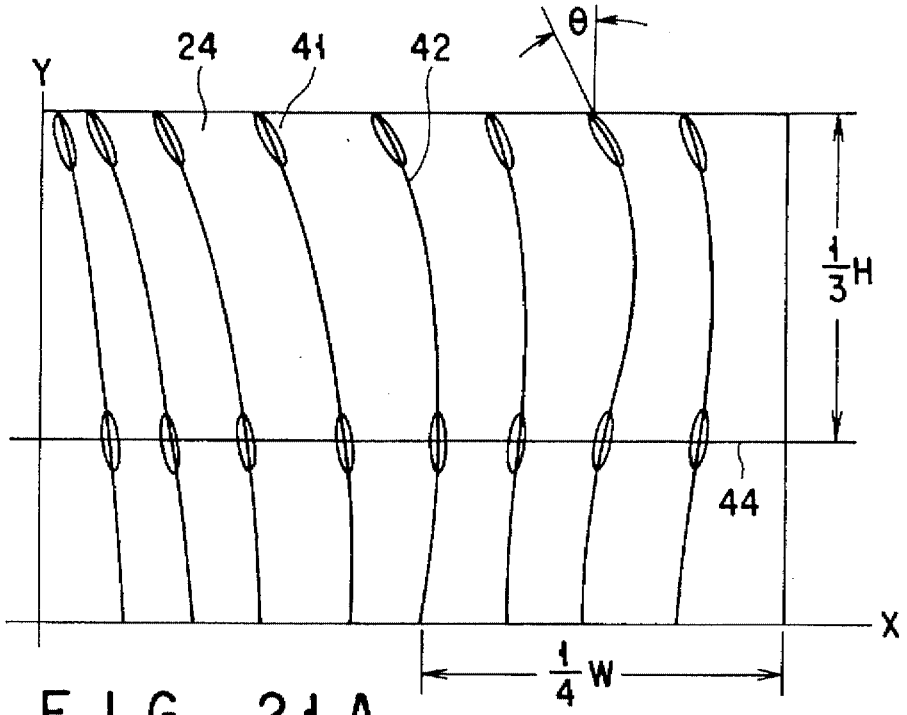
FIG. 21A is a diagram showing the aperture arrays made in the shadow mask incorporated in a color cathode-ray tube according to a fourth embodiment of the present invention.
Figure 21B:
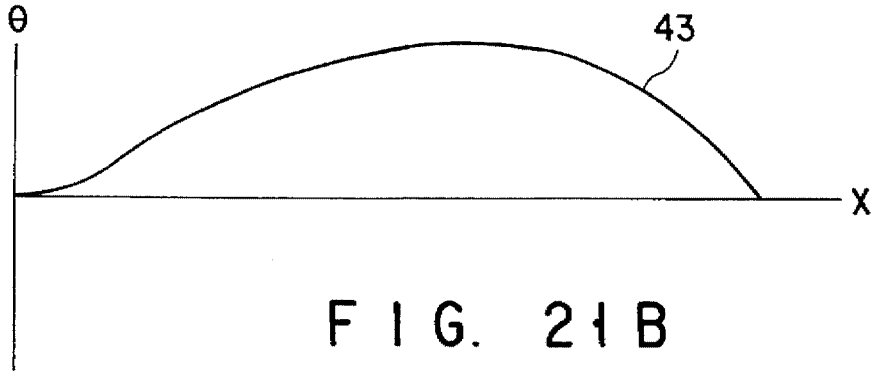
FIG. 21B is a graph representing how much the apertures arranged along the long side of the mask shown in FIG. 21A are inclined to the short axis of the mask.
Figure 21C:
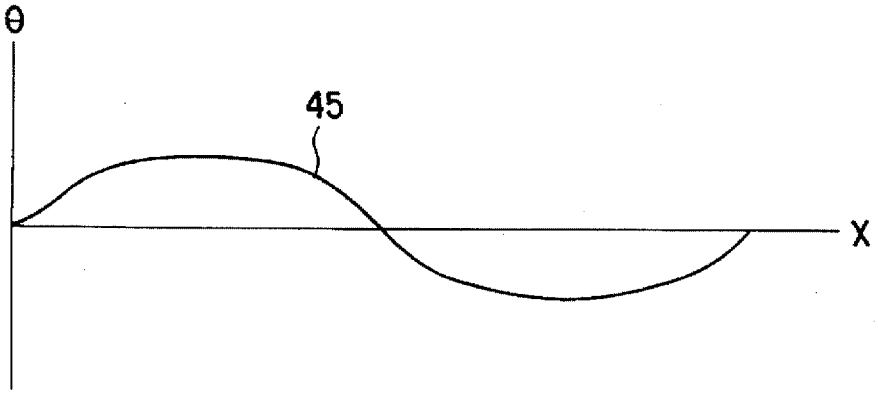
FIG. 21C is a graph representing how much the apertures arranged along an intermediate line spaced from the long side of the mask are inclined to the short axis Y of the shadow mask.

FIG. 21A shows the aperture arrays made in the effective part 24 of the shadow mask which is incorporated in the color cathode-ray tube. As shown in FIG. 21A, each aperture 41 is an elongated one. The apertures are arranged, forming arrays 42 which extend along the short axis Y of the effective part and juxtaposed along the long axis X of the effective part. More precisely, the arrays 42 curve differently. The apertures of each array 42 are inclined to the short axis Y of the effective part 24.

Here, an aperture 41 will be considered to be inclined by a positive angle θ if it is inclined toward the short axis Y of the effective part 24. As indicated by the curve 43 shown in FIG. 21B, all apertures 41 on the long side of the effective part 24 are inclined at positive angles θ. Of these apertures 41, the one located in a region to the short side from a line along the short axis, which passes through a point at a distance of one-fourth the width W of the effective part 24 from the short side thereof are inclined at the greatest positive angle θ. As indicated by the curve 45 shown in FIG. 21C, some of the apertures 41 on an intermediate line 44 spaced from the long side of the effective part 24 by one-third the height H of the effective part 24 are inclined by positive angles θ. The other apertures 41 on the line 44 are inclined at negative angles θ. More specifically, for the apertures 41 on the intermediate line 44, the angle θ gradually changes from the short axis Y toward the short side of the effective part 24, first increasing to a maximum positive value, then decreasing to a maximum negative value, and finally increasing to 0θ.

Figure 22:
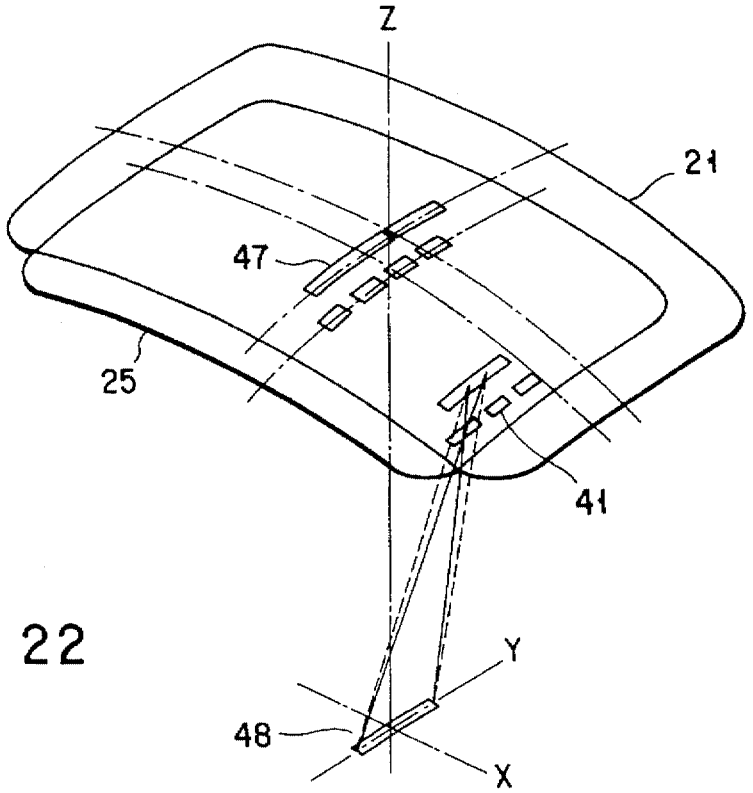
FIG. 22 is a perspective view illustrating the positional relation between the elongated light source for applying light on phosphor layers and the aperture arrays made in the shadow mask shown in FIG. 21A.

Since the apertures 41 are inclined so, an elongated light source 48 used to form the phosphor screen 23 by photolithography can be located, with its axis existing in the same plane as the axis of the aperture pattern formed on the inner source of the panel 21 as is illustrated in FIG. 22. Therefore, the phosphor stripes 37 formed by the photolithography are not bent zigzag, even on the four edge parts of the panel 21.

Figure 23:
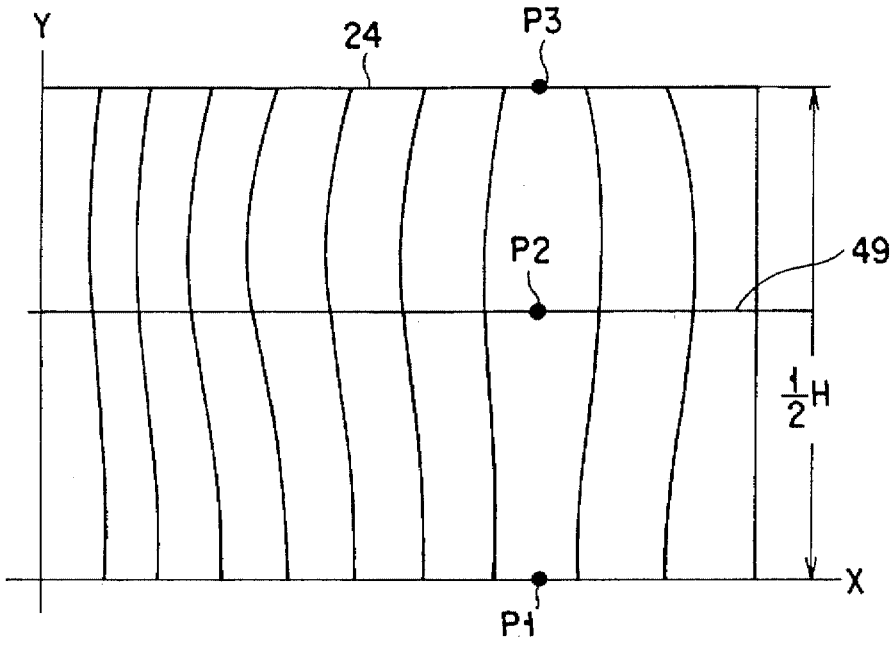
FIG. 23 is a diagram showing how much the aperture arrays made in the effective part of the shadow mask shown in FIG. 21A are spaced apart along the long axis X of the effective part.
Figure 24:
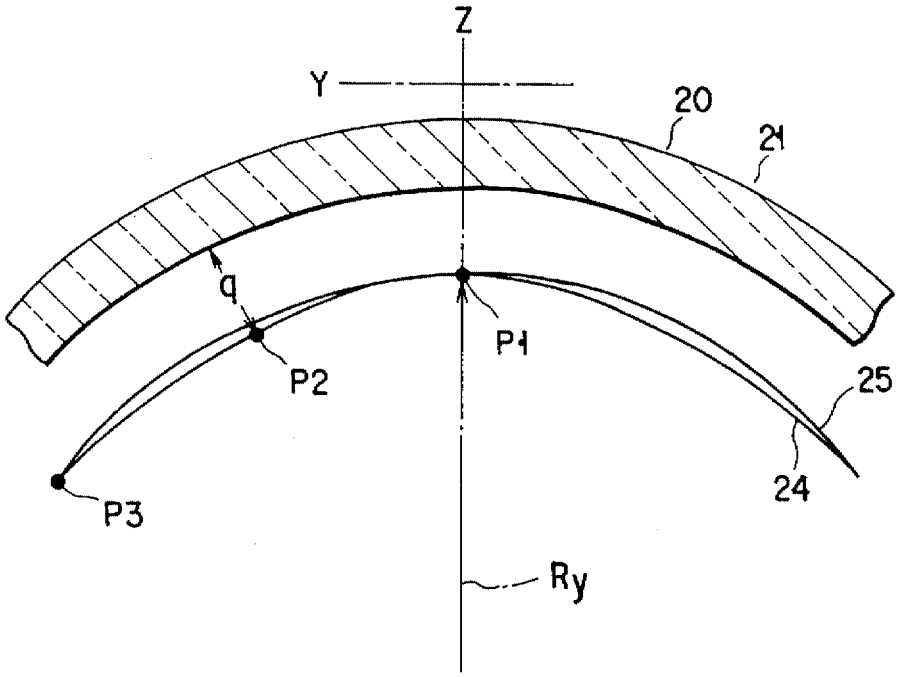
FIG. 24 is a diagram explaining how the doming of the shadow mask shown in FIG. 23 is suppressed.

As shown in FIG. 23, for the apertures on an intermediate line 49 extending parallel to the long axis X of the effective part 24 and spaced from the long axis X by one-fourth the height H of the effective part 24, the angle θ gradually changes from the short axis Y toward the short side of the effective part 24, first increasing to a maximum positive value, then decreasing to a maximum negative value, and finally increasing to 0θ. Hence, two adjacent aperture arrays 42 are spaced apart more at a point P2 on the intermediate line 49 than at a point P1 on the long axis X or at a point P3 on the long side. As shown in FIG. 24, the distance q between the effective part 24 of the shadow mask 25 and the inner surface of the effective panel part 20 is therefore long at the point P2 and short at the point P1. In other words, the effective part 24 of the mask 25 has a short radius Ry of curvature at the point P1. The local doming of the effective part 24 is suppressed effectively.

A color cathode-ray tube according to the fifth embodiment of the invention will be described, with reference to FIGS. 25A, 25B and 25C.

Figure 25A:
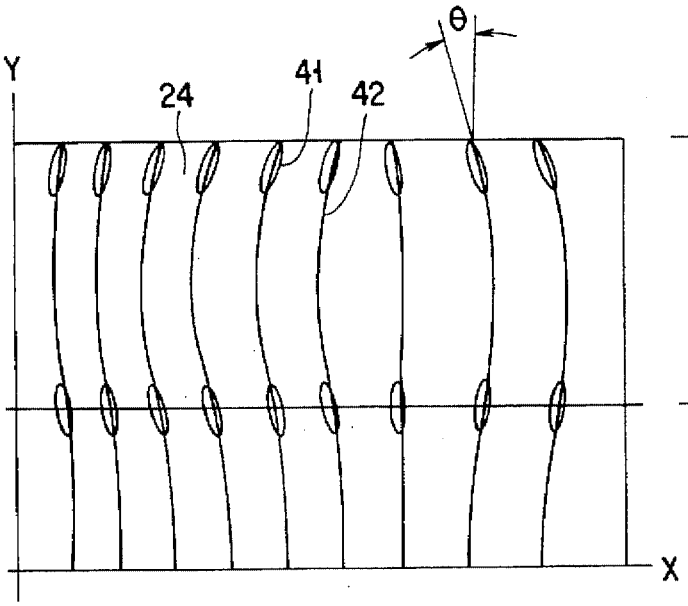
FIG. 25A is a diagram showing the apertures made in the shadow mask incorporated in a color cathode-ray tube according to a fifth embodiment of the invention.
Figure 25B:
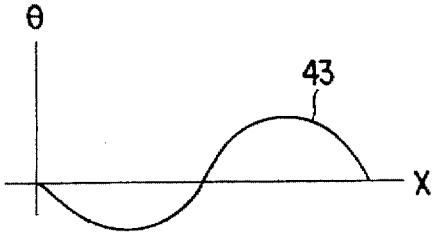
FIG. 25B is a graph representing how much the apertures arranged along the long side of the mask are inclined to the short axis Y of the mask shown in FIG. 25A.
Figure 25C:
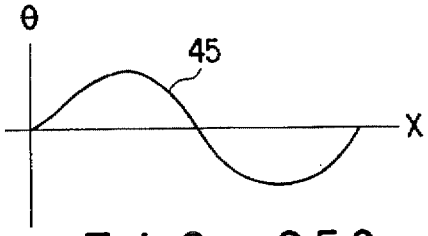
FIG. 25C is a graph representing how much the apertures arranged along an intermediate line spaced from the long side of the mask are inclined to the short axis Y of the mask shown in FIG. 25A.

FIG. 25A shows the apertures 41 made in the shadow mask incorporated in this color cathode-ray tube. As evident from FIGS. 25A and 25B, for the apertures 41 on the long side of the effective part 24 of the mask, the angle θ gradually changes from the short side of the effective part 24 toward the short axis y thereof, first decreasing to a maximum negative value, then increasing to a maximum positive value, and finally decreasing to 0θ. As shown in FIG. 25C, for the apertures 41 on an intermediate line extending parallel to the long axis X of the effective part 24 and spaced from the long side of the effective part 24 by one-third of the height H of the effective part 24, the angle θ gradually changes from the short axis Y toward the short side of the effective part 24, first increasing to a maximum positive value, then decreasing to a maximum negative value, and finally increasing to 0θ.

The apertures 41 are more inclined than the apertures of the shadow mask (FIG. 21A) incorporated in the fourth embodiment, so as to form phosphor stripes by photolithography, which are not bent zigzag, even on the four edge parts of the panel 21. Particularly, the apertures 41 located near the point P2 (FIG. 4) on an intermediate line parallel to the long axis X are very much inclined, whereby the effective part 24 has a shorter radius Ry of curvature at the point P1. The local doming of the effective part 24 is suppressed more effectively than in the shadow mask provided in the fourth embodiment.

The position which the center of each aperture 41 assumes in the effective part 24 can be represented by coordinates (x, y) in a coordinate system whose origin is the center of the effective part 24 and whose axes are the long axis X and short axis Y of the effective part 24. If the upper and lower halves of the effective part 24 are symmetrical with respect to the long axis X, the position of the aperture 41 is represented as an even function, provided that x is a fourth-degree function or a higher-degree function of y.

A color cathode-ray tube according to the sixth embodiment of the invention will be described, with reference to FIGS. 26A, 26B and 26C. The shadow mask incorporated in this cathode-ray tube is characterized in that its upper and lower halves are symmetrical with respect to the long axis Y.

Figure 26A:
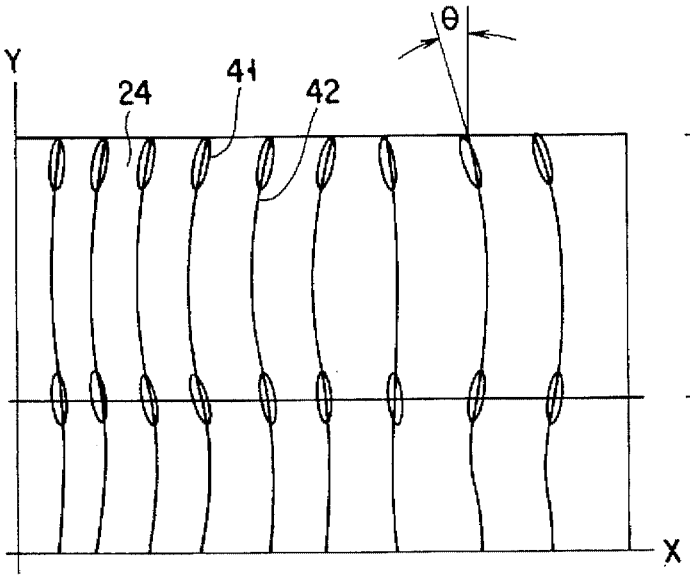
FIG. 26A is a diagram showing the apertures made in the shadow mask incorporated in a color cathode-ray tube according to a sixth embodiment of the invention.
Figure 26B:
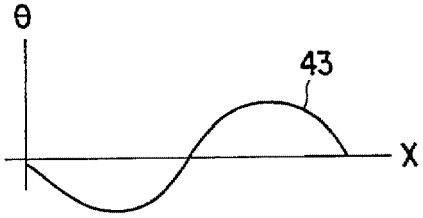
FIG. 26B is a graph representing how much the apertures arranged along the long side of the mask are inclined to the short axis Y of the mask shown in FIG. 26A.
Figure 26C:
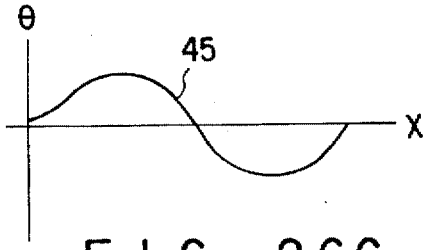
FIG. 26C is a graph representing how much the apertures arranged along an intermediate line spaced from the long side of the mask are inclined to the short axis Y of the mask shown in FIG. 26A.

FIG. 26A shows the apertures 41 made in the effective part 24 of the shadow mask. The position of each aperture 41 is represented by coordinates (x, y) in a coordinate system whose origin is the center of the effective part 24 and whose axes are the long axis X and short axis Y of the effective part 24. The value for x is a sixth-degree function of y. As shown in FIG. 26A, the arrays 42 of apertures meander, and the apertures 41 are inclined to the short axis Y of the effective part 24. More precisely, for the apertures 41 on the long side of the effective part 24, the angle θ gradually changes from the short side of the effective part 24 toward the short axis y of thereof, first decreasing to a maximum negative value, then increasing to a maximum positive value, and finally decreasing to 0θ as indicated by the curve 43 shown in FIG. 26B. For the apertures 41 on an intermediate line extending parallel to the long axis X and spaced from the long side of the effective part 24 by one-third of the height H of the effective part 24, the angle θ gradually changes from the short axis Y toward the short side of the effective part 24, first increasing to a maximum positive value, then decreasing to a maximum negative value, and finally increasing to 0θ as indicated by the curve 45 shown in FIG. 26C.

The shadow mask shown in FIG. 26A achieves the same advantages as the shadow mask (FIG. 25A) incorporated in the fifth embodiment, though it differs in that x is a higher-degree function of y.

As has been described, the present invention can provide a color cathode-ray tube which comprises a panel having a substantially rectangular effective part, a phosphor screen provided on the inner surface of the effective part of the panel, and a shadow mask having a curved, substantially rectangular effective part facing the phosphor screen and having a number of elongated apertures. The elongated apertures are arranged, forming arrays which extend along the short axis of the effective part and which are juxtaposed along the long axis of the effective part. The aperture arrays are curved in different ways. The elongated apertures are inclined at different angles to the short axis of the effective part. More precisely, of the apertures made in the section extending for one-fourth the width of the effective part from either short side thereof, those located near either long side of the effective part are more inclined than those located near the long axis of the effective part. For the apertures made in the section extending for one-third the height of the effective part from either long side thereof, the angle changes from the short axis of the effective part toward either short side thereof, first increasing gradually to a maximum positive value and then decreasing to 0° or to a negative value. Hence, an elongated light source used to form the phosphor screen by photolithography can be located, with its axis existing in the same plane as the axis of the aperture pattern formed on the inner surface of the panel. Therefore, the phosphor stripes formed by the photolithography are not bent zigzag, even on the four edge parts of the panel. Further, since the angles of the elongated apertures made in the section extending for one-third the height of the effective part from either long side thereof change as described above, the distance between any two adjacent aperture arrays in this section is relatively long. This section of the effective part therefore has a shorter radius of curvature. As a result, the local doming of the section is suppressed sufficiently, whereby the cathode-ray tube can display images having high color purity.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A color cathode-ray tube comprising:

electron-beam generating means for generating electron beams in in-line fashion;

a panel having a substantially rectangular effective part which has a curved inner surface;

a phosphor screen provided on the inner surface of the effective part of said panel, for emitting red, green and blue light rays when excited by the electron beams generated by said electron-beam generating means; and a shadow mask having a curved, substantially rectangular effective part facing the phosphor screen and having a number of apertures for guiding the electron beams to said phosphor screen, wherein said apertures are arranged, forming a plurality of arrays which extend along a short axis of the effective part of the shadow mask and are juxtaposed along a long axis of the effective part of the shadow mask, and a distance PH(N) between an (N−1)th array and an Nth array, counted from an array passing a center O of the effective part of the shadow mask, is given as:

$$PH(N)=A+BN^2+CN^4$$

where A, B and C are fourth-degree functions of a Y-coordinate in a coordinate system having an origin O being a center of the effective part of the shadow mask and having axes being a horizontal axis and a vertical axis of the effective part of the shadow mask, and C is a function first decreasing and then increasing as the absolute value of the Y-coordinate.

2. The color cathode-ray tube according to claim 1, wherein said effective part of said shadow mask has two long sides substantially parallel to said long axis and two short sides substantially parallel to said short axis, and a distance by which any two adjacent aperture arrays are spaced apart at the long axis is equal to a distance by which said any two adjacent aperture arrays are spaced apart at either of the two long sides.

3. The color cathode-ray tube according to claim 1, wherein a distance between the aperture arrays which are spaced about one-third of a width W of the phosphor screen from the short axis of the effective part of said shadow mask increases with an absolute value of the Y-coordinate and is represented by a fourth-degree function of the Y-coordinate so as to have a transition point in the effective part of the shadow mask with respect to the short axis of the effective part of the shadow mask.

4. The color cathode-ray tube according to claim 1, wherein a distance PH(M2) measured at two adjacent ones of the apertures located about one-fourth of a height of the effective part of the shadow mask measured from a long side of the effective part of the shadow mask, the long side being substantially parallel to the long axis, and located about one-third of a width of the effective part of the shadow mask measured from the short axis, is greater than a distance PH(M3) measured from two adjacent ones of the apertures located along the long side of the effective part of the shadow mask and located about one-third of the width of the effective part of the shadow mask measured from the short axis.

5. The color cathode-ray tube according to claim 4, wherein the distance PH(M3) is greater than the distance PH(M1) measured from two adjacent ones of the apertures located on the long axis and about one-third of the width of the effective part of the shadow mask from the short axis.

6. A color cathode-ray tube comprising:

electron-beam generating means for generating electron beams in in-line fashion;

a panel having a substantially rectangular effective part which has a curved inner surface;

a phosphor screen provided on the inner surface of the effective part of said panel, for emitting red, green and blue light rays when excited by the electron beams generated by said electron-beam generating means; and a shadow mask having a curved, substantially rectangular effective part facing the phosphor screen and having a number of apertures for guiding the electron beams to said phosphor screen, wherein said apertures are elongated and arranged, forming a plurality of arrays which extend along a short axis Y of the effective part of the shadow mask and are juxtaposed along a long axis X of the effective part of the shadow mask and the plurality of arrays are curved in different ways, the apertures are inclined at different angles to the short axis Y of said effective part of the shadow mask such that in a first section extending for one-fourth of a width of the effective part of the shadow mask from either of two short sides thereof, the apertures located near either of two long sides of the effective part of the shadow mask are more inclined than those located near the long axis X of the effective part of the shadow mask, and the apertures along either of the two long sides of the effective part of the shadow mask within the first section are inclined in an opposite direction to the apertures within the first section and extending for one-third of a height of the effective part of the shadow mask measured from a respective long side of the two long sides of the effective part of the shadow mask, and for the apertures made in a second section extending for one-third of the height of the effective part of the shadow mask from one of the two long sides thereof, the angle of each of the apertures, measured with respect to a line parallel to the short axis Y, changes from the apertures near the short axis Y of the effective part of the shadow mask to the apertures toward one of the two short sides thereof, the angle of each aperture first increasing gradually to a maximum positive value and then decreasing to one of 0° and a negative value.

7. The color cathode-ray tube according to claim 6, wherein a position of each of the apertures in said effective part of the shadow mask is represented by coordinates (x, y) in a coordinate system having an origin being a center of the effective part of the shadow mask and having axes being the long axis X of the effective part of the shadow mask and the short axis Y of the effective part of the shadow mask, where x is one of a fourth-degree even function of y and an even function of y with a degree higher than a fourth-degree.

8. The color cathode-ray tube according to claim 6, wherein the angle of each of the apertures within the first section and extending for one-third of the height of the effective part of the shadow mask measured from one of the two long sides is negative and the angle of each of the apertures within the first section and extending along the respective long side of the two long sides is positive.

* * * * *